US007163267B2

(12) United States Patent
Dumenil

(10) Patent No.: US 7,163,267 B2
(45) Date of Patent: Jan. 16, 2007

(54) MACHINE FOR PRINTING ON ARTICLES, THE MACHINE PRESENTING IMPROVED PROTECTION AGAINST ULTRAVIOLET RADIATION

(75) Inventor: François Dumenil, Chaumes En Brie (FR)

(73) Assignee: Machines Dubuit, Noisy le Grand (FR)

( * ) Notice: Subject to any disclaimer, the term of this patent is extended or adjusted under 35 U.S.C. 154(b) by 381 days.

(21) Appl. No.: 10/872,545

(22) Filed: Jun. 22, 2004

(65) Prior Publication Data

US 2005/0046648 A1 Mar. 3, 2005

(30) Foreign Application Priority Data

Jun. 23, 2003 (FR) ..... 03 07582

(51) Int. Cl.
*B41J 3/00* (2006.01)

(52) U.S. Cl. ..... 347/2; 347/91; 347/102

(58) Field of Classification Search ..... 347/2, 347/5, 91–92, 102; 101/38.1, 114, 115
See application file for complete search history.

(56) References Cited

U.S. PATENT DOCUMENTS 2,484,671 A 10/1949 Bauman ..... 101/115
4,962,702 A 10/1990 Eppinger ..... 101/114
6,164,199 A * 12/2000 Dubuit et al. ..... 101/38.1

FOREIGN PATENT DOCUMENTS

EP 1 099 550 5/2001

* cited by examiner

*Primary Examiner*—Stephen Meier
*Assistant Examiner*—Lam S. Nguyen
(74) *Attorney, Agent, or Firm*—Young & Thompson

(57) ABSTRACT

The invention relates to a printer machine for printing on articles, the machine comprising a plurality of article-carriers (16) each including a portion fitted with at least one shaft (218) for carrying at least one article, the article-carriers being suitable for moving in indexed manner along at least one plane path, the printer machine having a plurality of print stations where the articles receive printing, which stations are interposed with dryer stations for articles that have received printing, the machine being characterized in that the shaft for carrying said at least one article in each article-carrier is also suitable for moving transversely to its axis in the vicinity of the print stations which are offset from the travel plane of the article-carriers, so as to move away from said plane, thereby bringing the article into position for receiving printing inside a slot (180), said slot being formed in a protective screen (166) which protects the corresponding print station from radiation coming from the dryer stations.

17 Claims, 17 Drawing Sheets

Fig.7
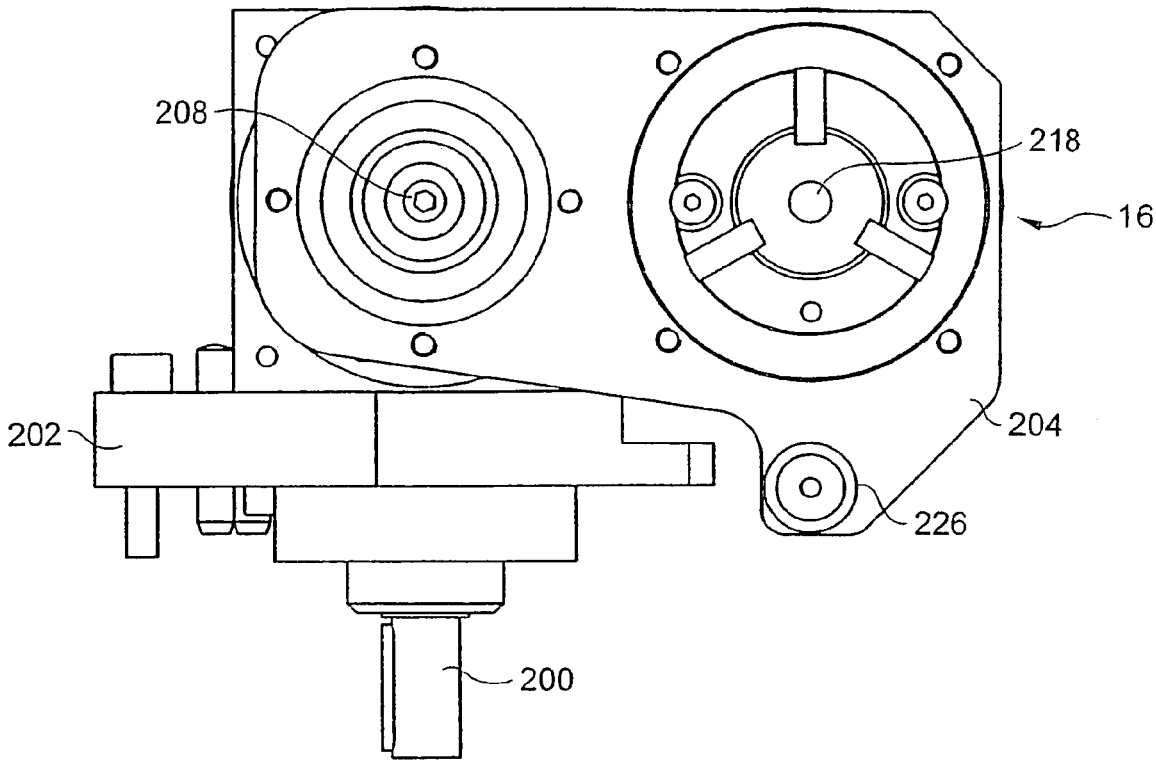
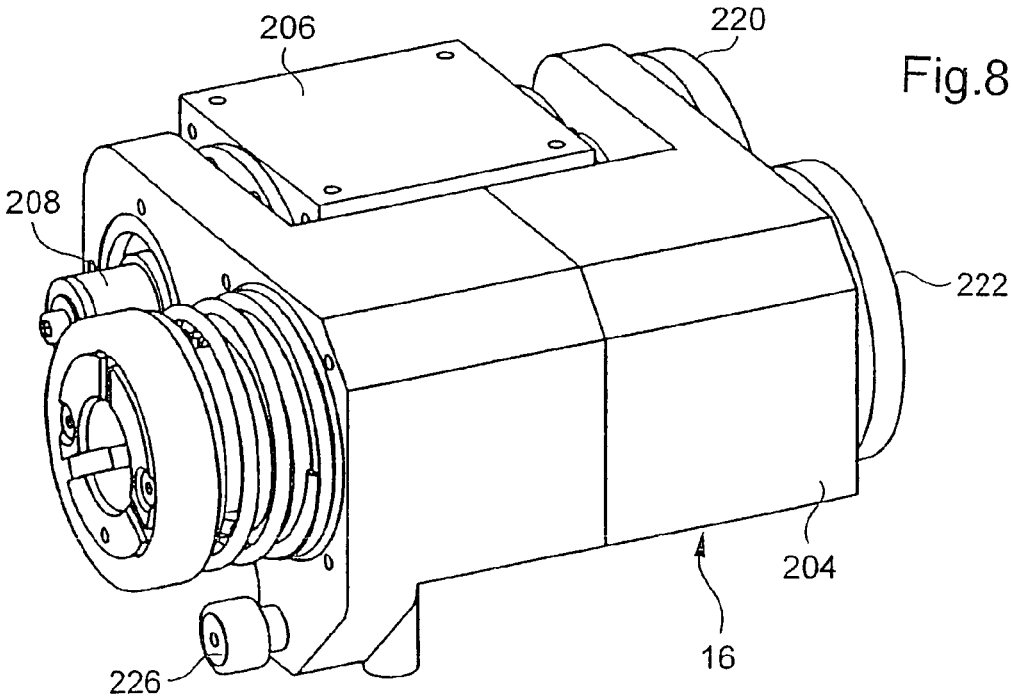
Fig.8

Fig.13
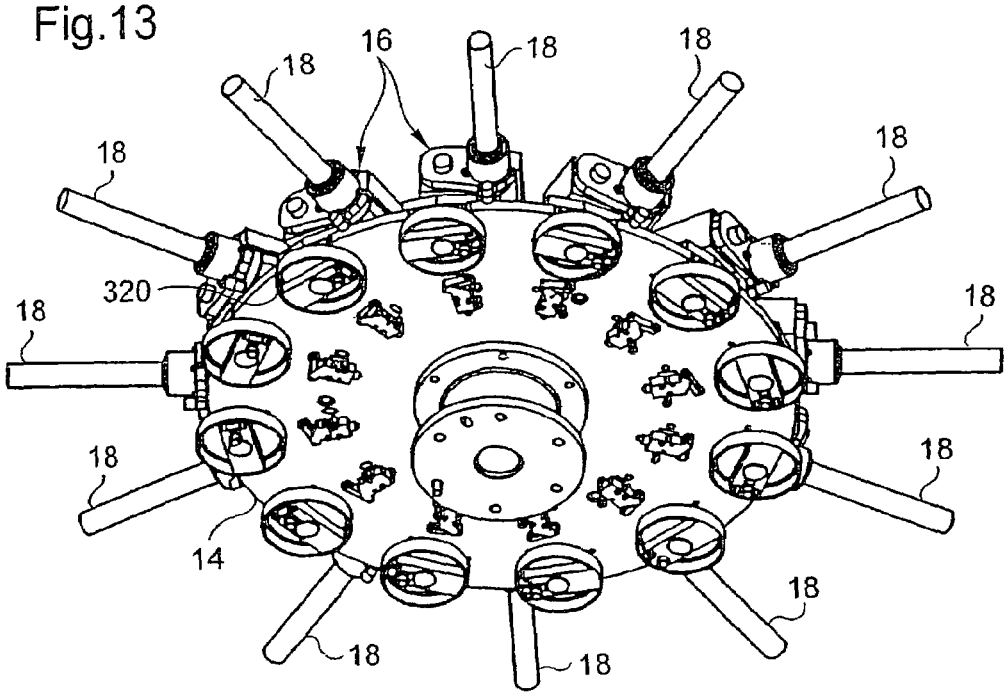
Fig.14 (A-A)
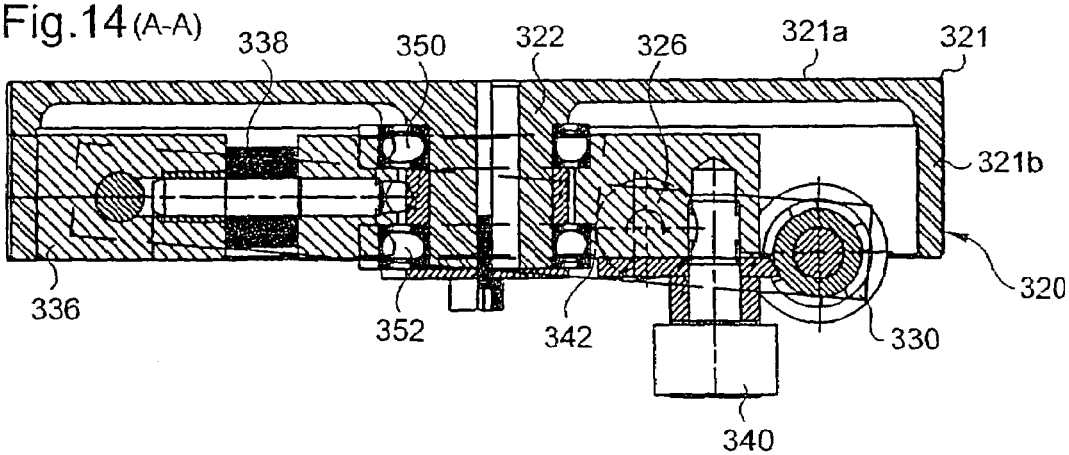
Fig.15 (B-B)
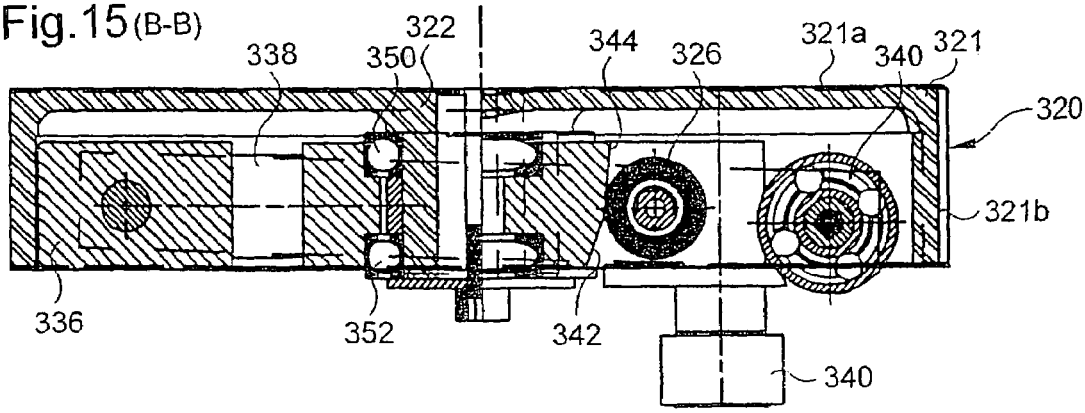

MACHINE FOR PRINTING ON ARTICLES, THE MACHINE PRESENTING IMPROVED PROTECTION AGAINST ULTRAVIOLET RADIATION

The present invention relates to a machine for printing on industrial articles such as bottles, flasks, various receptacles, and other objects of various shapes and types, such as, plastics tubes, for example.

Such machines are known that use ink to print decoration on articles.

As disclosed, e.g. in document FR 2 782 292 filed by the Applicant and in document U.S. Pat. No. 4,750,419, such machines comprise an indexed turntable on which article-carrier devices are fixed in position, each carrying an article to receive printing.

Each article-carrier device is provided with an outlet shaft on which the article is mounted and which extends radially relative to the axis of rotation of the turntable.

During rotation of the turntable in indexed manner, each article-carrier carrying its article that is to receive printing occupies a plurality of successive angular positions, each corresponding to a station for applying some particular printing treatment to the article: flame-cleaning, dedusting, pre-registry, registry, printing, and drying.

In that type of machine, the article-carrier, and thus the articles, follow a plane path which is circular, for example. The stations for printing on the articles and the stations for drying articles that have received printing are arranged along the path so that in the angular positions that correspond to said print stations and to said dryer stations, the article-carriers stop moving so that the respective operations of printing and drying can begin.

In the type of machine described in FR 2 782 292, each article for printing is protected from the radiation that comes from the drying ovens by pieces of sheet metal arranged on either side of the outlet shaft of the article-carrier on which the article is mounted.

The Applicant has found that that type of machine possesses several drawbacks.

For print stations using a printing screen that moves over the article that is to receive printing, and in contact therewith during the printing operation, it can be necessary, for example, to provide extra print length (over travel), and in particular at the beginning of printing in order to allow a doctor blade support to bring ink over the open mesh in the print screen constituting the pattern that is to be printed, so that the action of the doctor blade leads to decoration that is printed uniformly.

Unfortunately, such extra print length of the print screen is difficult to make compatible with the relatively limited empty space available for the print stations.

In addition, a dryer station provided after each print station runs the risk of disturbing the operation of printing because of the proximity of the radiation coming from the dryer stations.

One solution might consist in reducing the power of the radiation intrinsic to the dryer stations, but that would run the risk of penalizing the drying operation, encouraging underexposure to radiation in certain zones of an article that has received printing.

The Applicant seeks to remedy at least one of the above-described drawbacks by providing a printer machine for printing on articles, the machine comprising a plurality of article-carriers each having a portion fitted with at least one shaft for carrying at least one article, the article-carriers being suitable for moving in indexed manner along at least one plane path, the printer machine having a plurality of print stations where printing is applied to the articles and which are interposed with stations for drying articles that have received printing, the machine being characterized in that the shaft for carrying said at least one article in each article-carrier is also suitable for moving parallel to its axis in the vicinity of print stations which are offset from the travel plane of the article-carriers, and for moving away from said plane so as to bring the article into position for printing inside a slot, said slot being formed in a protective screen which protects the corresponding print station from the radiation coming from the dryer stations.

Thus, the fact of inserting the article for receiving printing in a slot in a protective screen of a print head considerably limits the radiation coming from the dryer stations which, in the prior art, interfered with printing operations.

This advantage is obtained in particular by moving the print stations away from the travel plane of the article-carriers and by making the article-carriers suitable for moving away from said plane.

Furthermore, by offsetting the print stations in a zone of the machine where the available space is of larger dimensions, the print length of the print screens is no longer limited as before, thus making it possible to implement print extra print length (over travel).

Furthermore, moving the print stations away from the dryer stations contributes to reducing the influence of radiation coming from the dryer station on printing operations.

According to a characteristic, the shaft for carrying said at least one article of each article-carrier is also suitable for moving parallel to its axis, in the vicinity of the dryer stations which are offset from the travel plane of the article-carriers, and for moving away from said plane, so as to bring the article into position for drying opposite to a slot, said slot being formed in a protective element which forms a screen against the radiation coming from the corresponding dryer station.

This also makes it possible to limit the radiation coming from the dryer stations insofar as the article to be dried occupies the slot almost completely.

According to a characteristic, the print stations and the dryer stations are arranged respectively on opposite sides of the travel plane of the article-carriers.

According to a characteristic, the portion of each article-carrier that includes the shaft is also suitable for moving away from the travel plane of the article-carriers and is referred to as a first portion, the remaining portion of the article-carriers, referred to as a second portion, being suitable solely for traveling along the plane path.

According to a characteristic, the first portion of each article-carrier is pivotally mounted relative to the second portion.

According to a characteristic, the shaft of each article-carrier is moved away from the travel plane of the article-carriers by co-operation with the portion of each article-carrier that includes said shaft and a locally-adapted cam profile.

According to a characteristic, the portion of each article-carrier including the shaft has a guide element which is suitable for moving along a guide path that comprises, outside those portions of the path that have the locally-adapted cam profile, portions that are substantially plane lying in a plane parallel to the travel plane of the article-carriers.

According to a characteristic, the vicinity of each print station and/or each dryer station, the cam profile comprises a sloping ramp.

According to a characteristic, the shaft on each article-carrier is moved away from the travel plane of the article-carriers by co-operation between the portion of each article-carrier including said shaft and a stationary actuator.

According to a characteristic, the actuator is suitable for causing the shaft to move perpendicularly to the travel plane of the article-carriers.

This arrangement makes it possible to obtain vertical displacement (perpendicularly to the travel plane of the article-carriers) for the shaft of the article-carrier carrying the article, thus achieving more accurate positioning of the article in the slots of the print and/or dryer stations.

According to a characteristic, the actuator is suitable for turning a ball screw on which a carriage is mounted to move in translation in a direction perpendicular to the travel plane of the article-carriers, said carriage being provided with a slot for co-operating with a guide element of the portion of each article-carrier that includes said shaft in order to cause said guide element to move during movement of the carriage in translation.

This particularly simple mechanism makes it possible to obtain the desired displacement.

According to a characteristic, the machine includes means for adjusting the distance of the print stations relative to the travel plane of the article-carriers as a function of the dimensions of the articles that are to receive printing.

The architecture of the machine thus enables it to be adapted advantageously to different articles (articles of different shapes and sizes) on which it is possible to apply printing.

According to a characteristic, the machine includes means for adjusting the distance of the dryer stations relative to the travel plane of the article-carriers as a function of the dimensions of the articles to be dried.

The architecture of the machine thus makes it possible to adapt it advantageously to different articles (different in shape and size) which it is possible to dry.

According to a characteristic, for print stations including respective print screens protected from radiation by the protective screen, the means for adjusting the distance of the print stations relative to the travel plane of the article-carriers are adapted to lift said print stations away from said plane through a distance that allows maintenance operations to be performed, in particular on the print screen.

The architecture of the machine thus facilitates performing maintenance operations on the print heads, and in particular on the print screen. For example when a screen is to be replaced, the print stations are raised through a distance that is sufficient to allow the operation to be performed, which distance is greater than the distance used while the machine is in operation.

According to a characteristic, the protective screen of each print station is retractable in order to allow maintenance operations to be performed on the print screen.

In which case, it is appropriate to raise the print stations relative to the travel plane of the article-carriers through a distance which allows the protective screens to be retracted.

According to a characteristic, the article-carriers are suitable for moving along a circular trajectory.

According to another characteristic, the machine includes an indexed turntable on which the article-carriers are mounted.

Other characteristics and advantages appear from the following description given purely by way of non-limiting example and made with reference to the accompanying drawings, in which.

Figure 1:
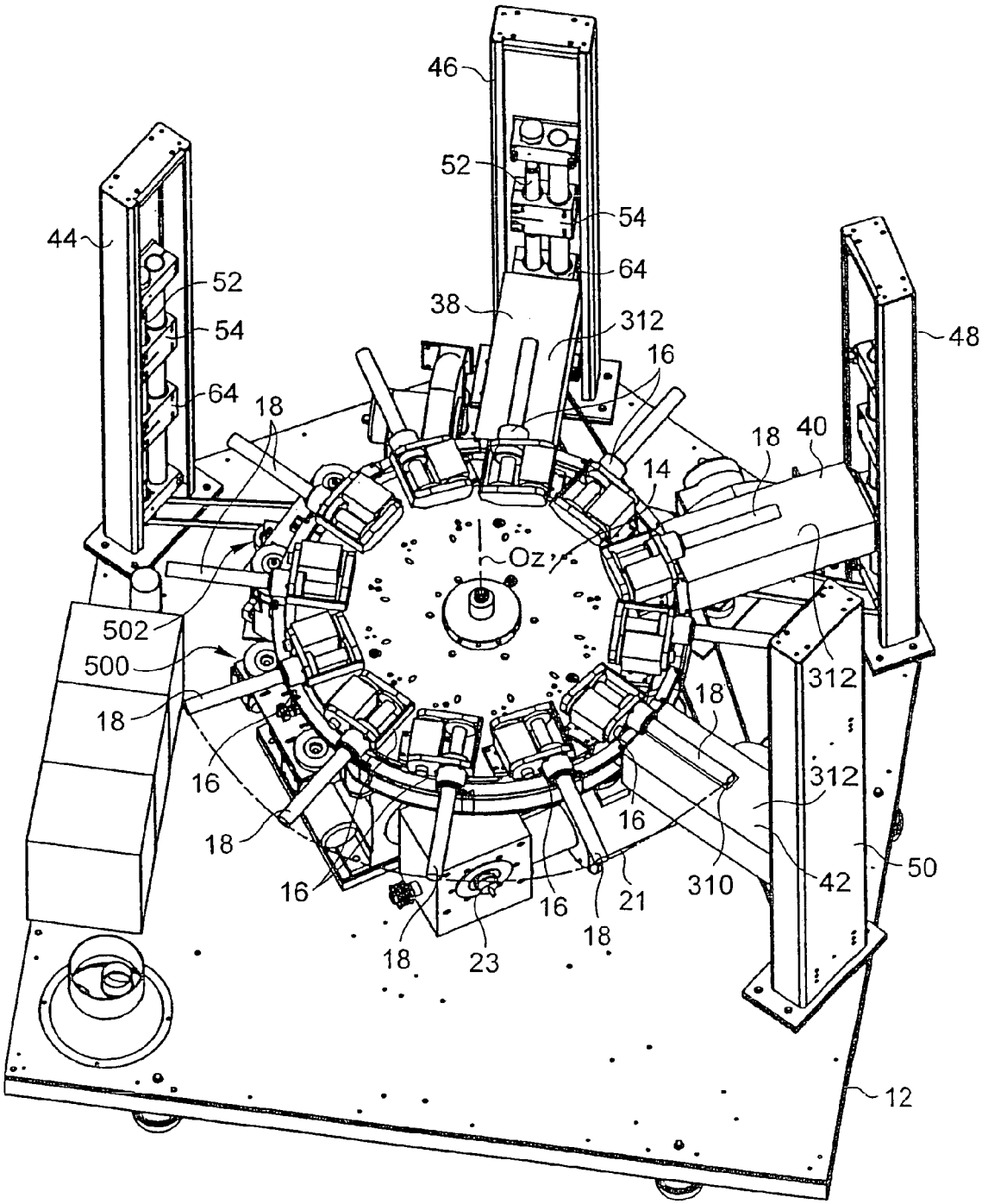
FIG. 1 is a general perspective view of a machine of the invention for printing on articles, from which the upper portion has been removed for reasons of clarity (i.e. the print stations have been removed)
Figure 3A:
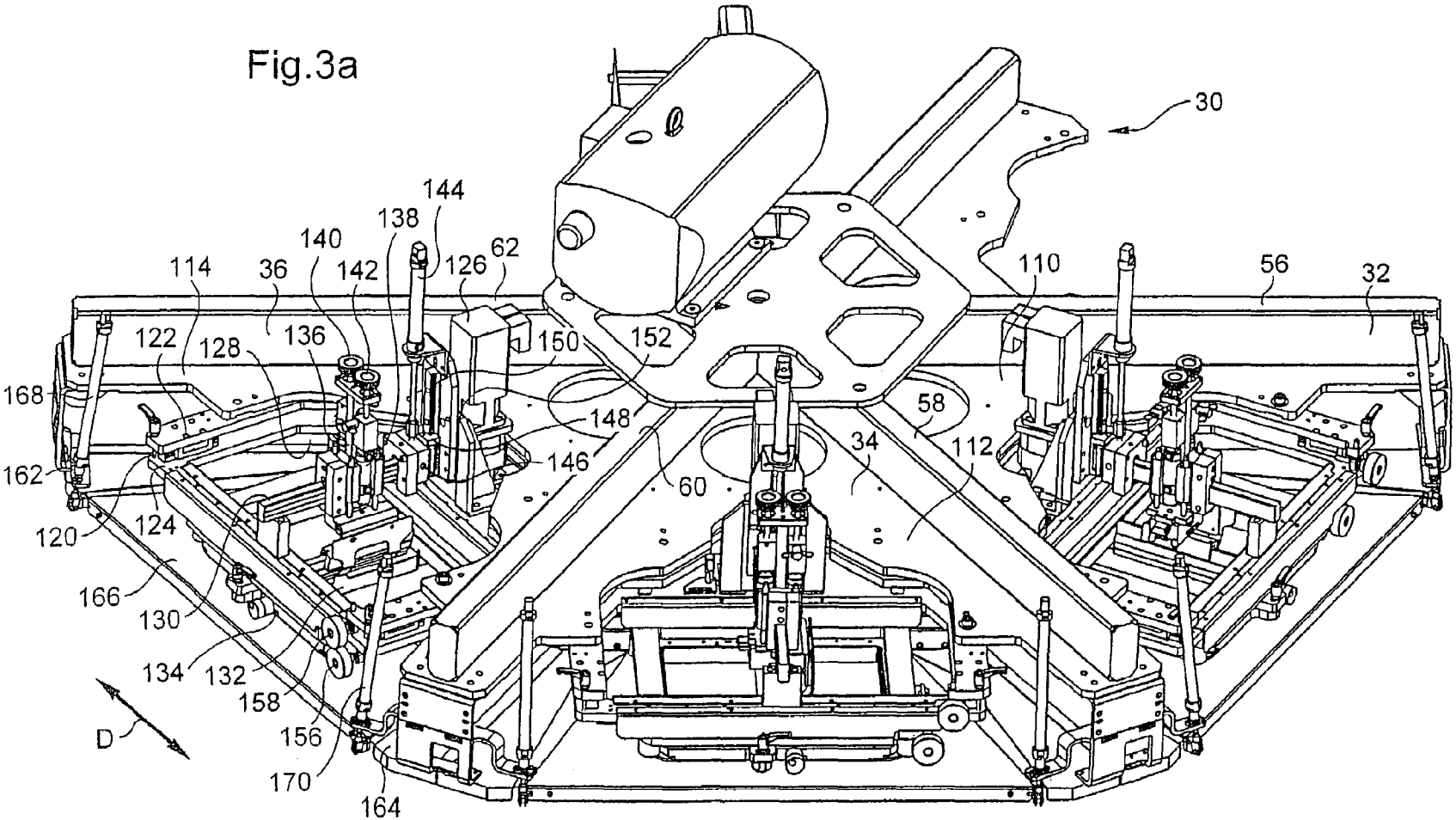
Figure 3B:
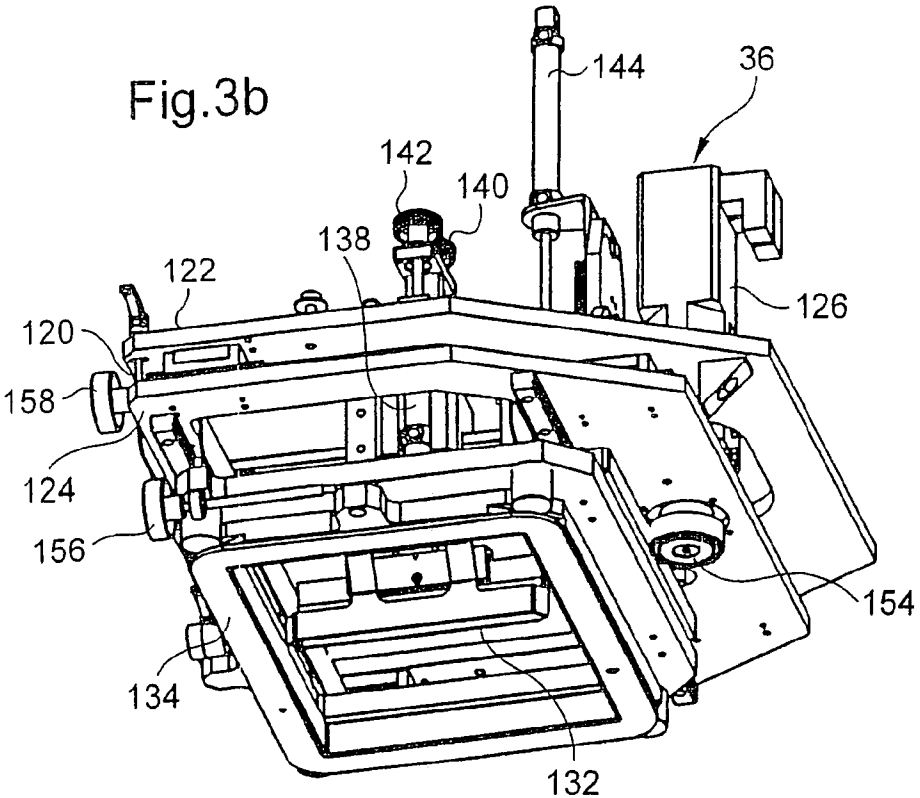

FIG. 3*a* is a fragmentary perspective view of the upper portion that is removed from the device as shown in FIG. 1;

FIG. 3*b* is a perspective view from beneath of one of the print heads of FIG. 3*a;*

Figure 4:
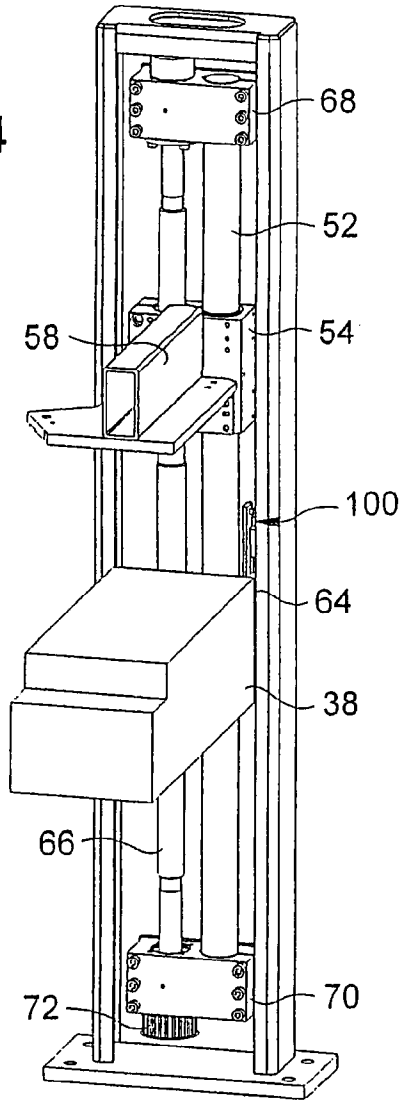
Figure 5:
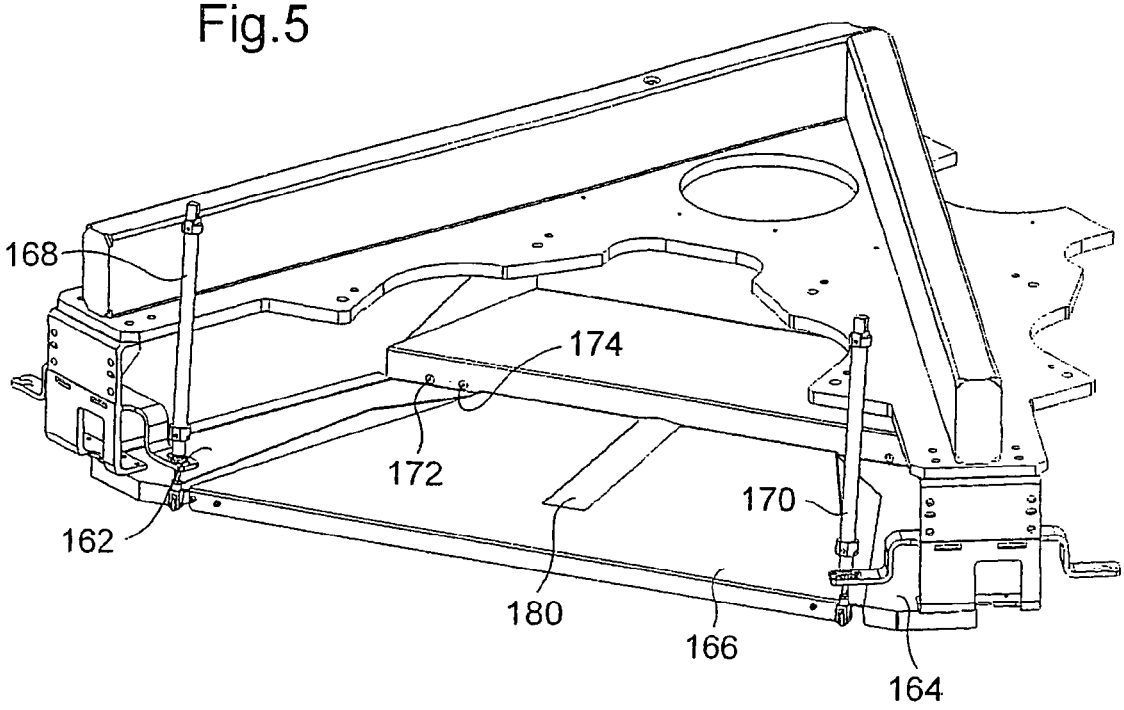
Figure 6:
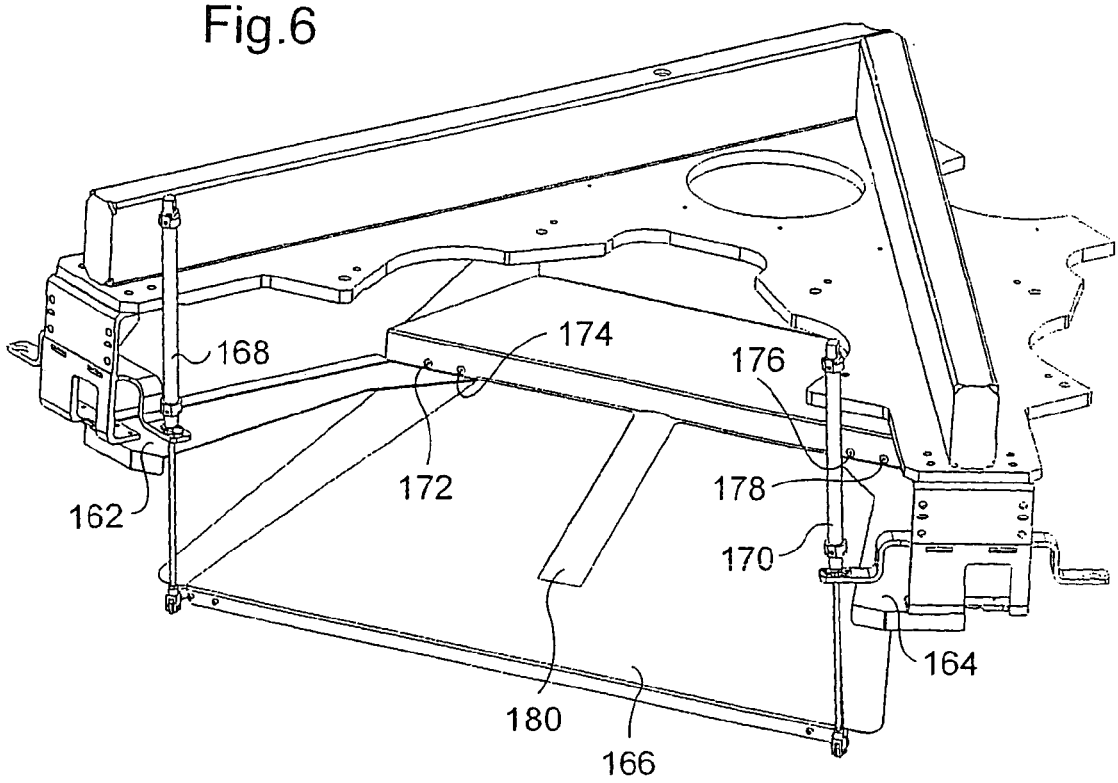
Figure 9:
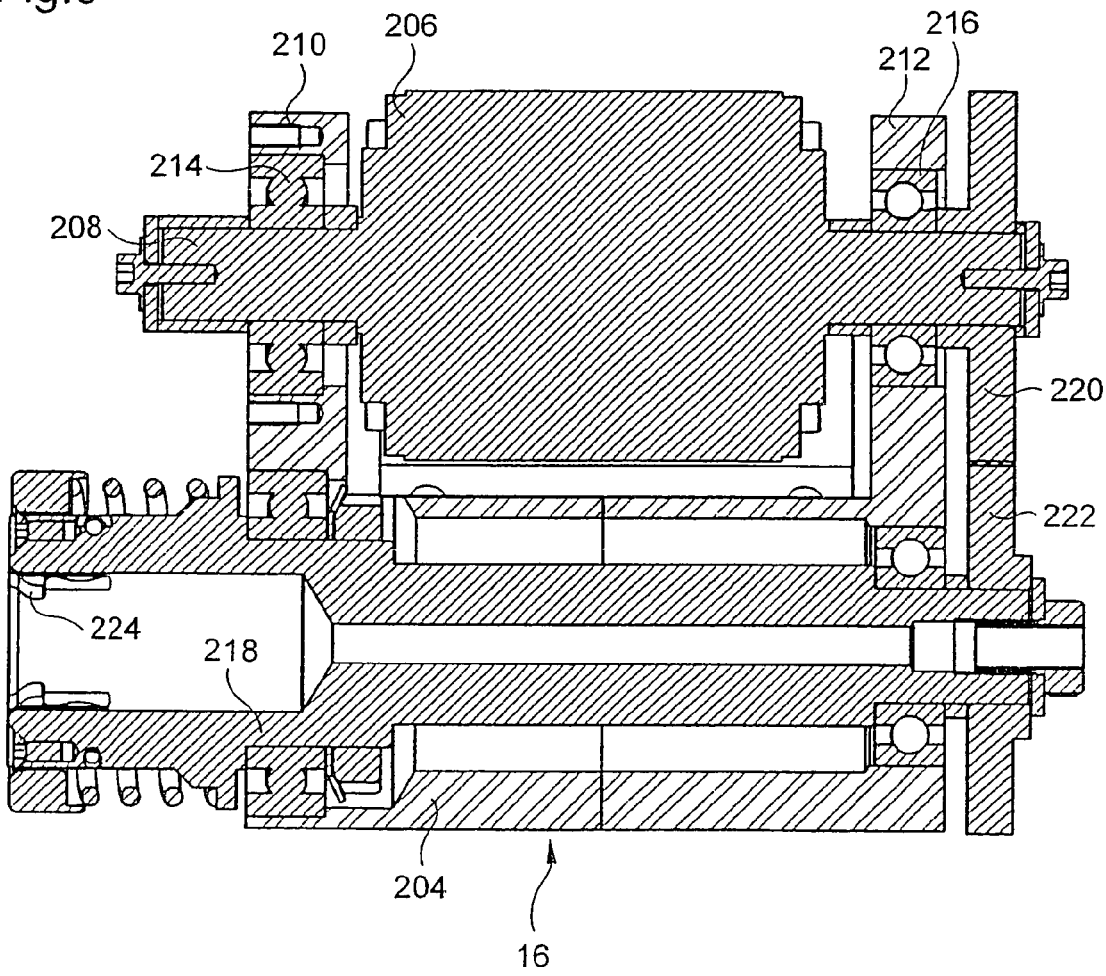
Figure 10:
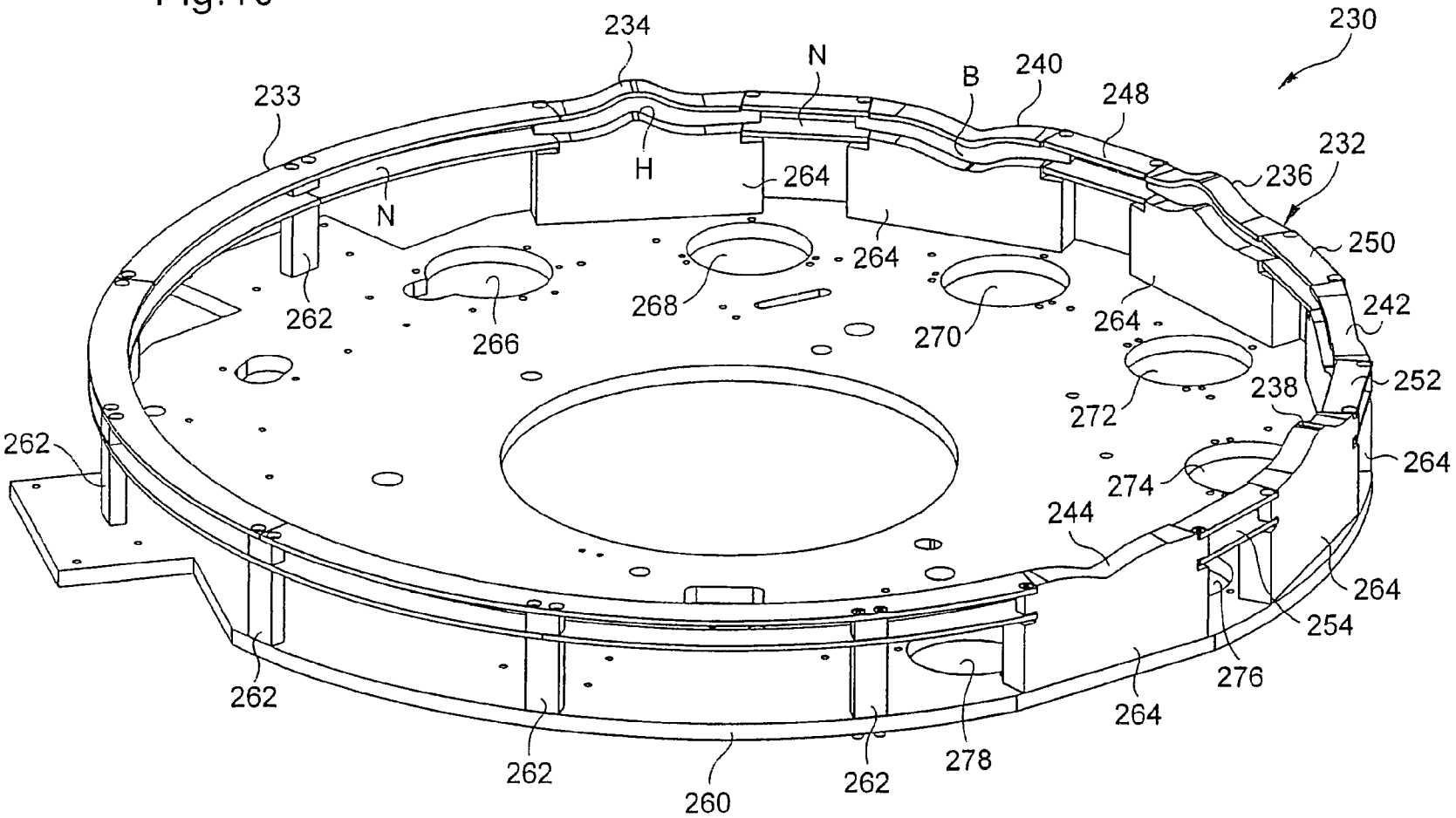
Figure 11A:
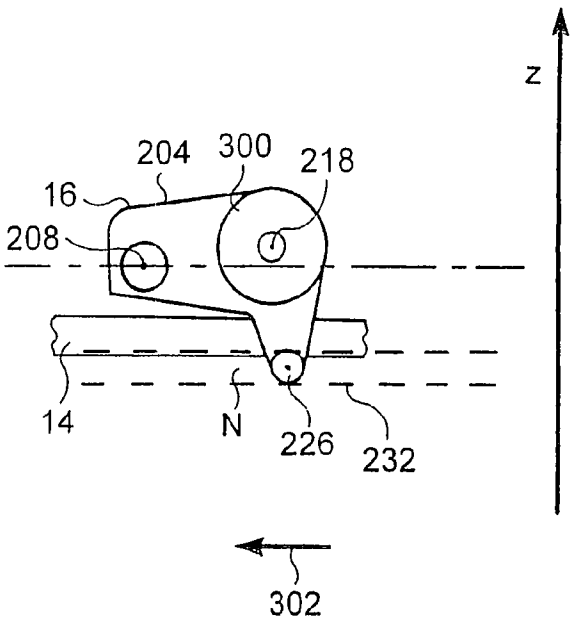
Figure 11B:
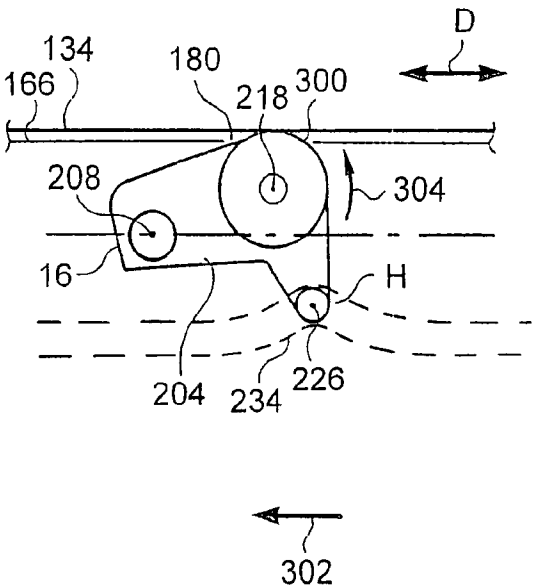
Figure 11C:
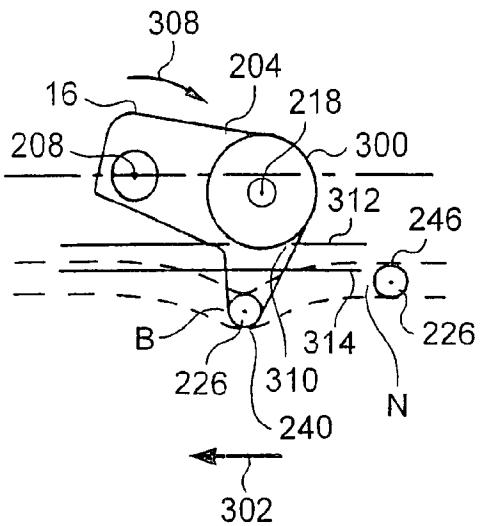
Figure 12A:
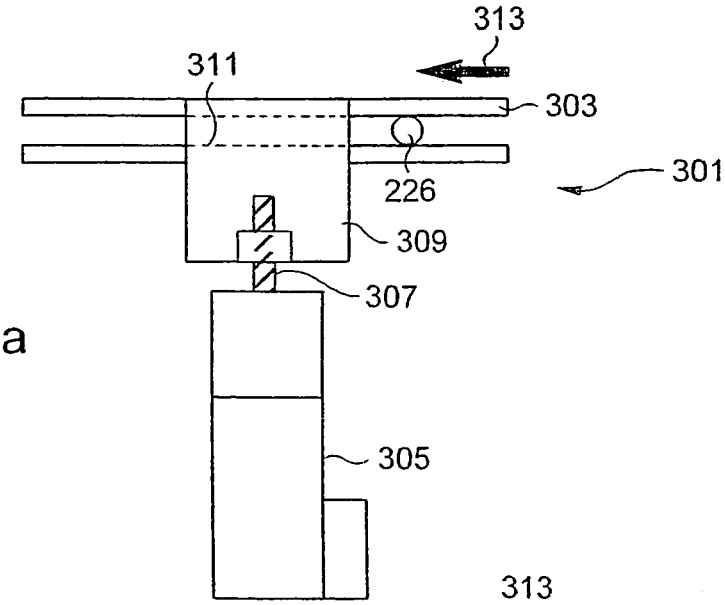
Figure 12B:
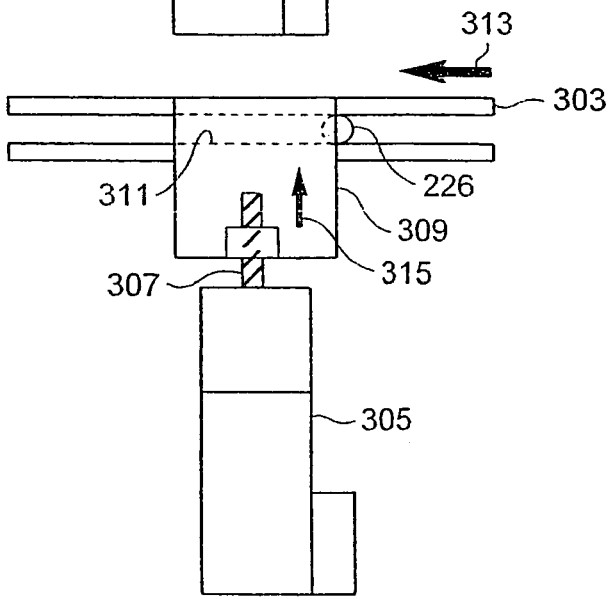
Figure 12C:
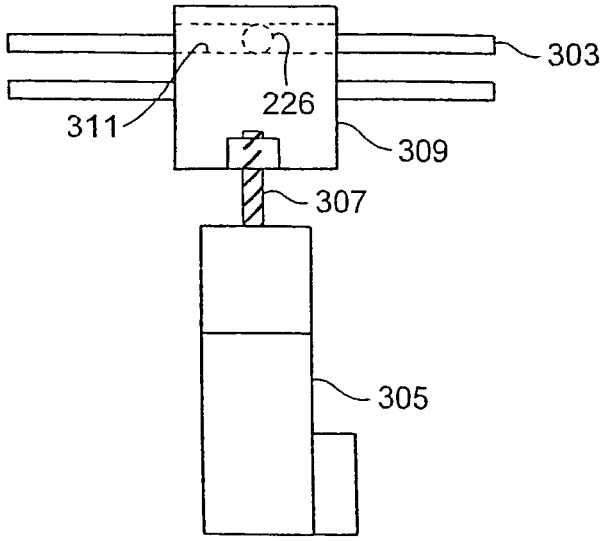
Figure 16:
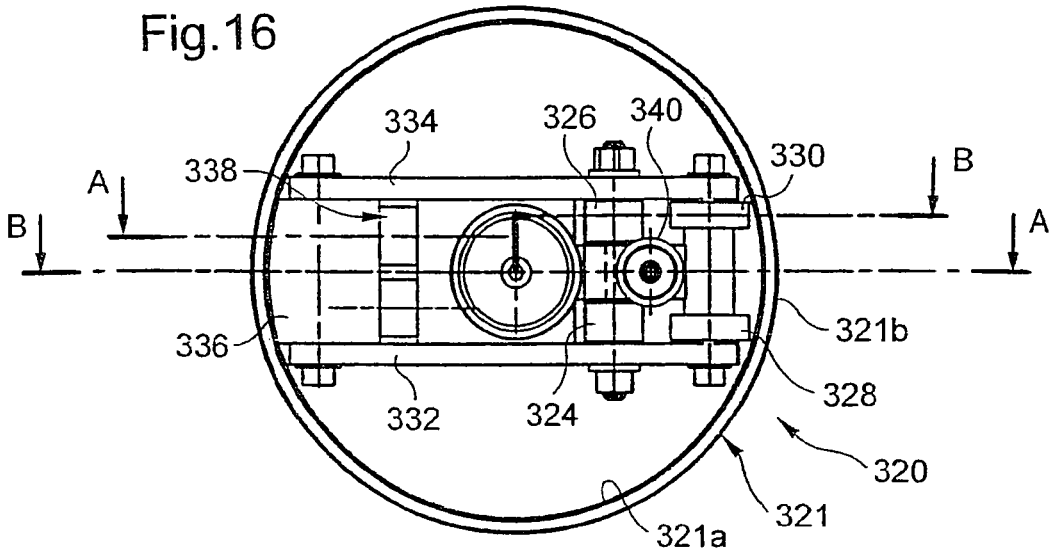
Figure 17:
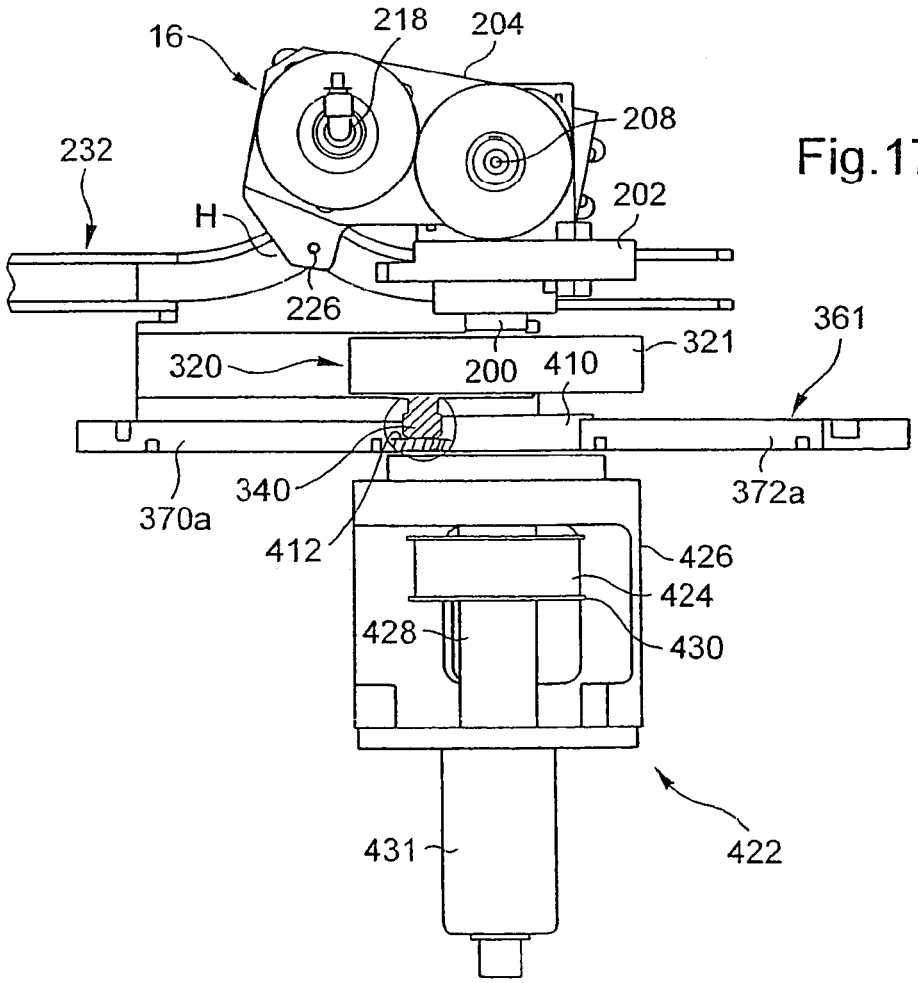
Figure 19:
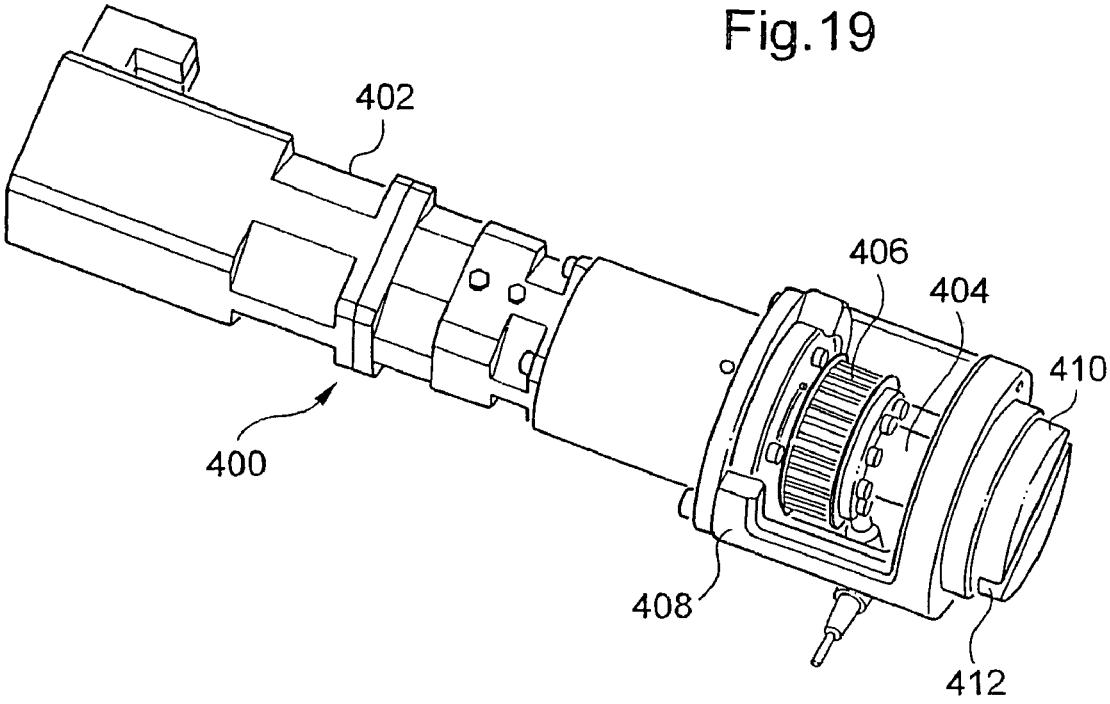
Figure 20:
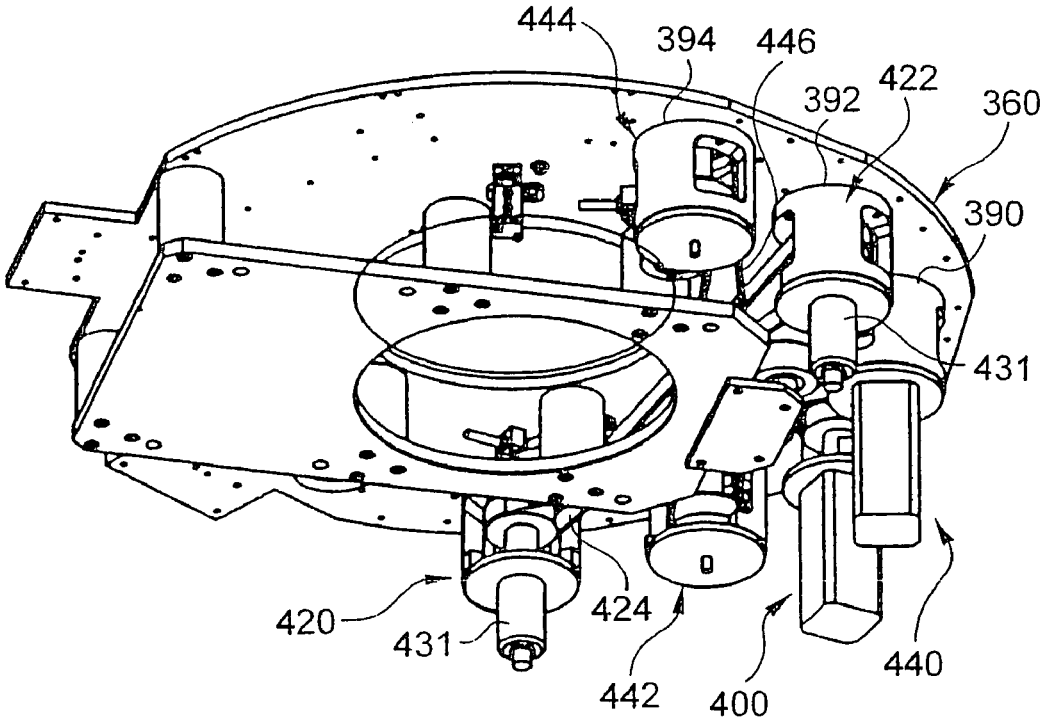
Figure 23:
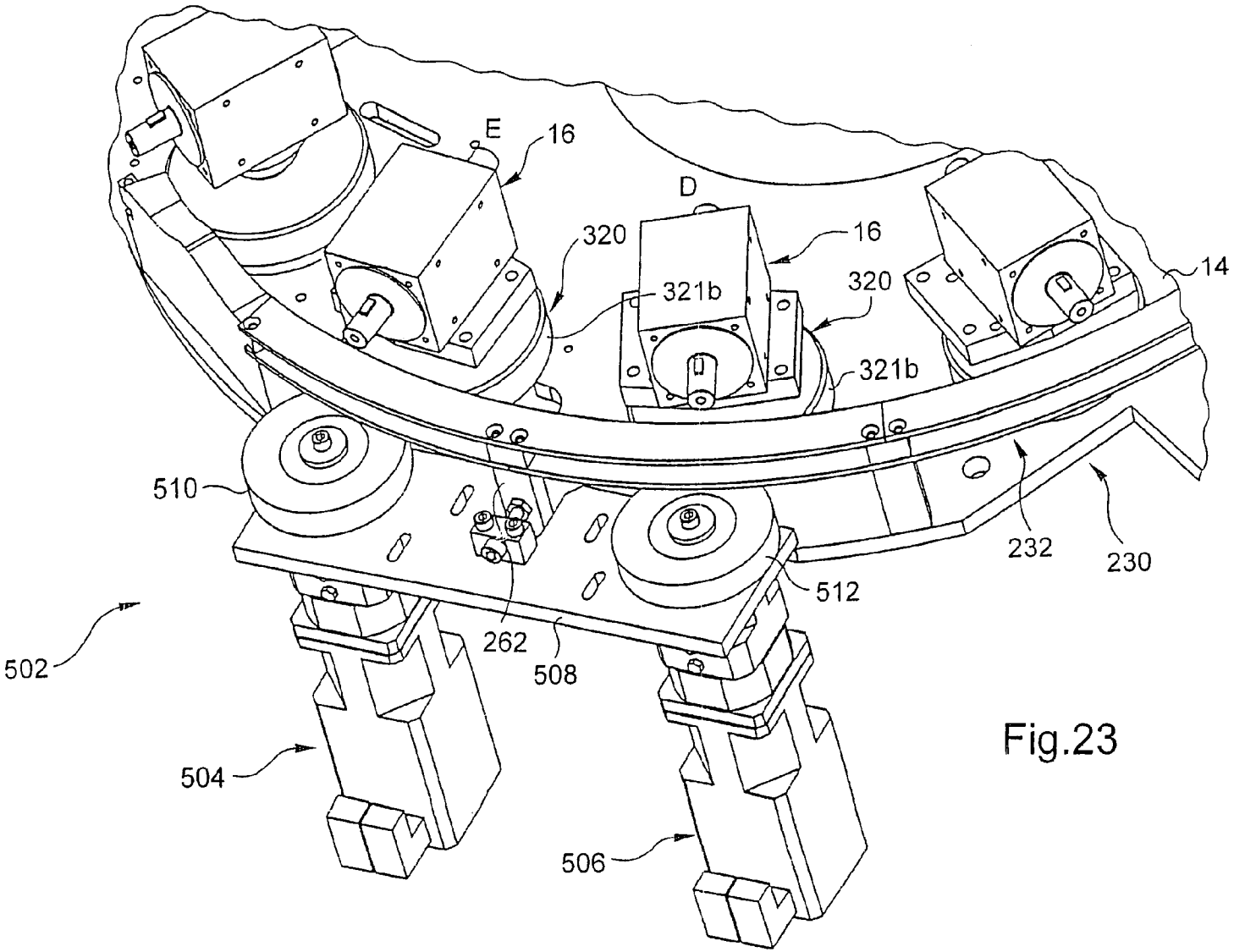
Figure 18:
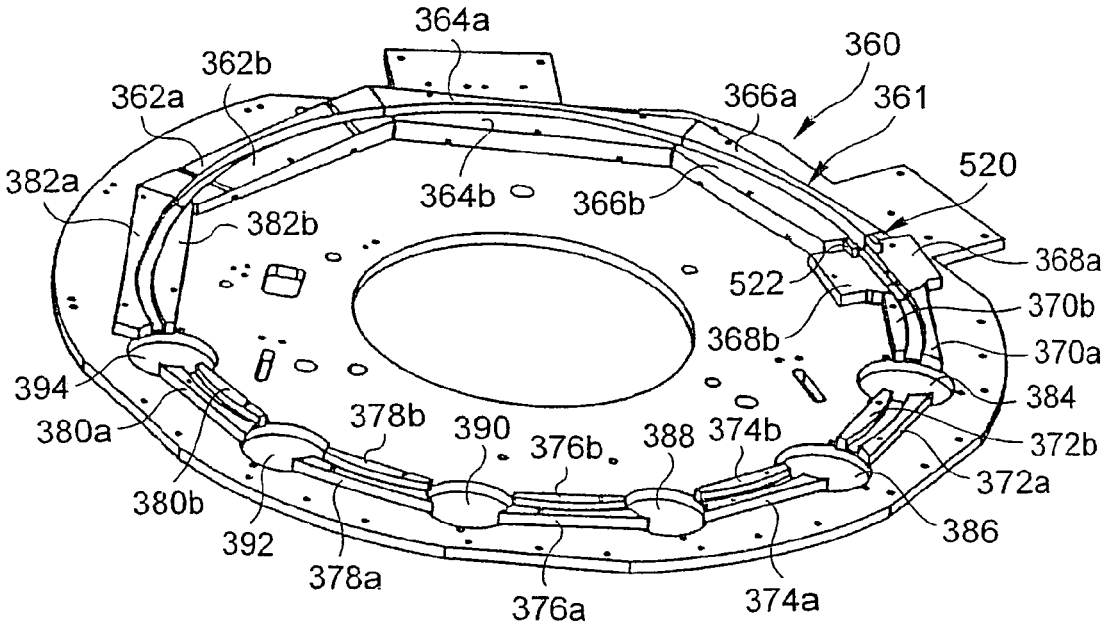
Figure 24:
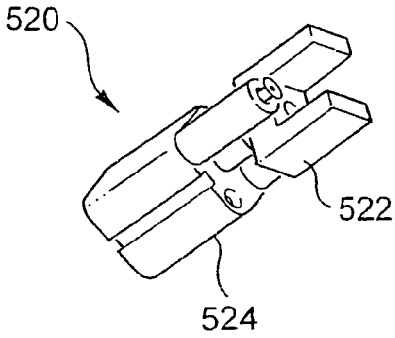

FIG. 4 is a detailed view of one of the pillars shown in FIG. 1;

FIGS. 5 and 6 are views showing the angular sector that receives the print head 36 of FIG. 3*b*, respectively showing the protective sheet in a working position (FIG. 5) and in a retracted position (FIG. 6);

FIGS. 7 to 9 are respectively a front view, a perspective view, and a section view of the article-carrier shown in FIG. 1;

FIG. 10 is a diagrammatic view of a stationary table incorporating a guide path for the guide element 226 of the article-carrier shown in FIGS. 7 to 9;

FIG. 11*a* to 11*c* show three respective possible positions for an article-carrier of the invention;

FIGS. 12*a* to 12*c* show a variant embodiment of means enabling the article-carriers to be moved vertically;

FIG. 13 is a perspective view from beneath of the turntable 14 fitted with the article-carriers 16;

FIGS. 14 and 15 are diagrammatic views in section respectively on planes AA and BB shown in FIG. 16 and showing a clutch mechanism of an article-carrier of the invention, respectively in the clutched position and in the declutched position;

FIG. 16 is a view from beneath of the clutch mechanism shown in FIGS. 14 and 15;

FIG. 17 is a diagrammatic view seen from the center of the turntable 14 showing an article-carrier and its drive and guide means;

FIG. 18 is a perspective view of the cam path followed by the guide element 340 of the article-carriers;

FIG. 19 shows an actuator for turning an article-carrier;

FIG. 20 is a perspective view from beneath of the cam path shown in FIG. 18 and relative to which the various drive means are arranged;

FIGS. 21*a* to 21*g* show respectively the successive positions of the guide element 340 of an article-carrier while it is co-operating with a moving path portion 410 in register with a drying station;

FIGS. 22*a* to 22*h* show respectively the successive positions of the guide element 340 of an article-carrier while it is co-operating with a moving path portion 410 opposite to a print station;

FIG. 23 is a fragmentary diagrammatic view on a larger scale showing a portion of the FIG. 1 turntable 14 at the pre-registry station and at the registry station; and FIG. 24 is a perspective view of a clutch member of the clutch mechanism 320 shown in FIGS. 14 to 16.

As shown in FIG. 1 and given overall reference 10, a machine for printing on industrial articles such as bottles, comprises a fixed frame 12 constituting the base of the machine and supporting a turntable 14 having a plurality of article-carriers 16, each fitted with a mandrel 18 for receiving the article for printing.

In FIG. 1, articles are not shown engaged on the mandrels for reasons of clarity.

It should be observed that other mounting equipments could alternatively be provided, such as, for example, a socket-and-spike system.

FIG. 1 shows twelve article-carriers by way of example, it being understood that this number can vary from one machine to another.

The various article-carriers are fixed in conventional manner to the periphery of the turntable 14, with the mandrels 18 mounted on the outlet shafts of the article-carriers being arranged radially relative to the axis of rotation (Oz) of the turntable and projecting from the periphery of said turntable.

Figure 2:
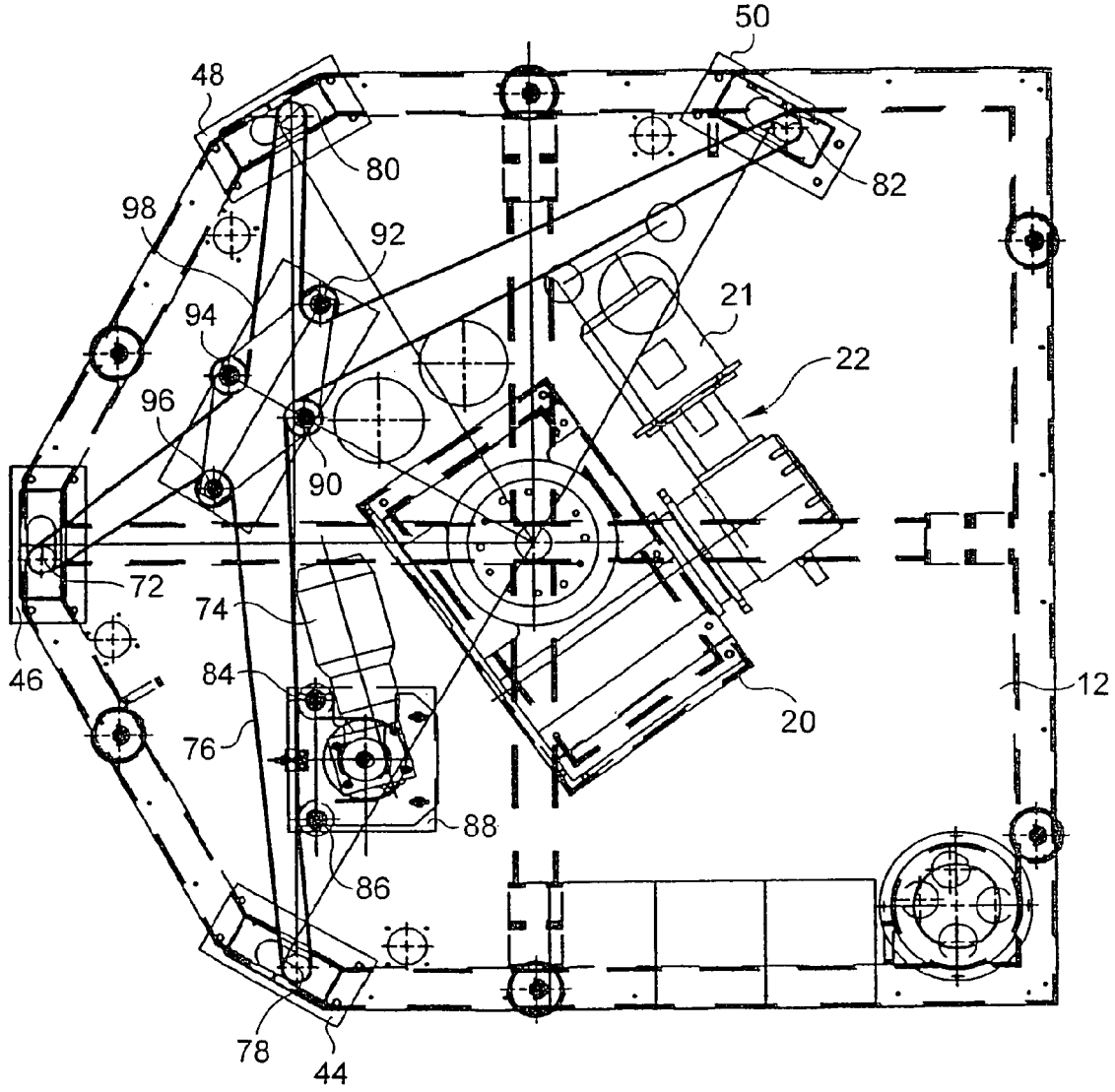
FIG. 2 is a plan view showing how the various elements shown in FIG. 1 are located on the frame 12 of the machine.

The turntable is caused to turn in indexed manner, i.e. stepwise, by means of an indexing unit shown in FIG. 2.

The indexing unit comprises in conventional manner an indexer 20 associated with a motor and gearbox unit 22 disposed beside the indexer.

The main motor driving the indexer 20 possesses internally an incremental coder 21 having 5000 points per revolution, and on the outlet shaft of the gearbox, there is arranged an absolute coder 23 which provides information about the angular position of the "slow" shaft coming from the motor and gearbox unit 22, in the form of 360 angular positions.

The absolute coder provides an origin point or O point for the machine, i.e. the point from which the indexer starts its rotation.

On initial startup, an origin is defined so as to initialize the counting of the incremental coder relative to the absolute coder.

Very accurate information is thus obtained concerning the change as a function of time in the position of the slow shaft, and consequently in the position of the turntable 14 at the outlet of the indexer.

This information is forwarded to each variable control circuit driving the actuators (motors) whose cycles are associated with the cycle of the indexer, e.g. for causing articles to turn under the print heads and over the drying ovens.

The angular position of each motor implementing the various transmissions is defined as a function of the number of points counted by the incremental coder.

Starting from the above-mentioned point of origin, the variable controllers of the various actuators of the article-carrier inlet shafts are incremented by a number of points equivalent to one revolution of the outlet shaft of the gearbox.

For a gearbox providing a reduction ratio of 1/20, that amounts to incrementing by 100,000 points, and for each given point, there is a corresponding position of the actuator in a table.

It is thus possible to obtain extremely accurate relative phase control between the variable control circuit controlling the motor of the actuator and the movement of the indexed turntable.

FIG. 3*a* shows the portion forming the upper framework of the printer machine of the invention which is normally arranged over the turntable 14 and the article-carriers 16.

The upper framework 30 has three print stations 32, 34, 36 (print heads) disposed side by side in a common plane that is different from the plane of the article-carriers.

As shown in FIG. 1, the printer machine of the invention also has three dryer stations 38, 40, 42 which are arranged in a common plane that is situated beneath the plane in which the article-carriers are located.

These three stations constitute the lower framework of the machine.

In this embodiment, the machine has three print stations and three dryer stations that are offset relative to the travel plane of the article-carriers, however its architecture may be adapted to configurations having two print stations and two dryer stations, or possibly a higher number of stations.

The print machine also comprises four vertical support pillars 44, 46, 48, and 50 fixed to the frame 12 in positions where they stand around the turntable 14 and the article-carriers 16.

It should be observed that the number of pillars could be greater, depending on the number of print stations and dryer stations and on the architecture of the machine.

Each vertical pillar, such as the pillar shown in FIG. 4, comprises a vertical column 52 having two carriages slidably mounted thereon, one of them being a top carriage 54 connected to one of the radial cross-members 56, 58, 60, 62 of the upper framework 30 of FIG. 3*a*, for example, the cross-member 58.

A second carriage 64 is also slidably mounted on the column 52 that constitutes a slideway, this carriage being secured to one of the dryer stations 38, 40, 42, and more particularly to an ultraviolet (UV) radiation dryer oven such as the oven 38 of FIG. 1, for example.

Each carriage 54, 64 is also mounted on a screw 66 with oppositely-handed threads extending parallel to the column 52.

As shown in FIG. 4, the two opposite ends of the column 52 and the screw 66 with oppositely-handed threads are held in place in respective top and bottom boxes 68 and 70 which are permanently secured to the machine.

The bottom end of the screw 66 projects from the box 70 and is engaged inside a pulley wheel 72 which, when turned, serves to rotate the screw with oppositely-handed threads.

As shown in FIG. 2, a motor and gearbox unit 74 drives a cog belt 76 whose path, shown in plan view in this figure, is determined so as to pass via the various driving pulley wheels 72, 78, 80, and 82 of the corresponding screw with oppositely-handed threads which are arranged inside respective pillars 46, 44, 48, and 50.

A belt path as shown is obtained by mounting the belt 76 around two deflector wheels 84, 86 arranged on a plate 88 on which the motor and gearbox unit 74 is mounted and around four deflector wheels 90, 92, 94, and 96 that are fixed to a plate 98.

Thus, the motor and gearbox unit 74 drives the belt 76 which meshes with the pulley wheels 72, 78, 80, and 82, thus acting symmetrically, depending on the direction of rotation of the motor, to cause the carriages 54 and 64 and the pillars 44, 46, 48, and 50 to move towards each other or apart from each other, thereby moving the print heads and the dryer ovens that are fixed respectively to said carriages towards each other and apart from each other.

The respective up and down movements of the lower framework (dryer stations) and of the upper framework (print heads) which are offset relative to the turntable, are controlled as a function of operating requirements (adjusting the spacing between the stations as a function of the dimensions of the articles), or for machine maintenance.

A position sensor 100 mounted on a rod which is itself arranged on a bar fixed to the carriage 64 provides information concerning the vertical positions of the carriages carrying the dryer ovens, thus making it possible to control in three dimensions the opening and closing of the lower and upper frameworks of the machine.

Thus, simultaneous vertical adjustment of the print heads and of the dryer ovens makes it possible to adapt the machine to articles of various shapes and sizes.

The machine is therefore not restricted in its operation by the articles for printing being of dimensions that are too large.

Furthermore, for maintenance operations such as, for example, changing the indexer 20, it is advantageous to be able to move the lower and upper frameworks apart from each other.

In addition, and as explained below, the ability of the print heads to move vertically is advantageous for obtaining access to the print screen in order clean it, or indeed replace it.

Furthermore, this offset configuration for the print heads and the dryer stations makes it possible to increase considerably the print length of the print screens relative to a prior art machine, the travel of the print screens then being limited by the thermal protection elements placed on either side of the articles.

It should also be observed that the above-described arrangement is also advantageous even when only the print stations are offset or when the printer machine in question has print heads only and no dryer ovens.

A print head of a print station mounted on the upper framework 30 of the printer machine of the invention is described below with reference to FIGS. 3*a*, 3*b*, 5, and 6.

As shown in FIG. 3*a*, the print heads 32, 34, and 36 are arranged in spaces defined between two consecutive radial cross-members amongst the cross-members 56, 58, 60, and 62, and more particularly the angular spaces or sectors provided are made in the form of cutouts in respective pieces of sheet metal 110, 112, and 114.

There follows a description of the structure of the print head 36 which is identical to that of the other heads 32 and 34.

The print head 36 comprises a two-part frame 120 in which the top part 122 is fixed to the cut-out sheet 144 by conventional means, while the bottom part 124 serves as a support for a motor 126, an assembly 128 sliding on a radial slideway 130 and carrying an assembly 132 comprising a doctor blade and a doctor blade support, together with a print screen 134.

The assembly 128 also comprises a cylinder actuator 136 for controlling vertical down or up movement of the doctor blade and an actuator 138 for controlling vertical up or down movement of the doctor blade support.

Two adjustment buttons 140 and 142 are also provided, respectively for the doctor blade and the doctor blade support.

An cylinder actuator 144 is provided for lifting the doctor blade/doctor blade support assembly and it is connected to a block 146 secured to a shoe 148 suitable for sliding on the slideway 150 mounted vertically on a framework-forming structure 152 which is fixed to the bottom frame 124.

Movement of the screen in translation in the direction shown by the double-headed arrow referenced D in FIG. 3*a* is provided by a rack-and-pinion assembly 154 which is driven by the motor 126, as can be seen in FIG. 3*b* which is a perspective view of the print head as seen from beneath.

Two adjustment buttons 156 and 158 are provided respectively on the front portion of the print head 36 in order to make it possible to turn the print screen in the x,y plane and perform depth adjustment, i.e. to adjust the screen radially relative to the axis of rotation of the turntable 14.

As shown in FIG. 3*a*, a plurality of protection elements forming a thermal protection screen, in particular protective metal sheets, are arranged in the bottom portion of the framework 30 beneath the print head 36 so as to protect the print head from the ultraviolet radiation emitted by the dryer ovens which are disposed beneath the radial cross-members 60 and 62.

The protective elements for each print head are more particularly defined by two stationary protective sheets 162 and 164 having a hinged protective sheet 166 arranged between them capable of moving between a working position shown in FIG. 5 and a retracted position shown in FIG. 6, which position is used when maintenance work needs to be performed on the print head, such as replacing the print screen.

Two cylinders-actuators 168 and 170 are fixed via one end, each to two respective angle brackets (not shown) which are secured to the radial cross-members 60, 62, and via respective opposite ends to the moving protective sheet 166 which is hinged about a hinge that is not visible but which has fastening screws 172, 174, 176, 178 that can be seen in FIG. 6.

During maintenance work that requires the sheet 166 to be retracted, the print heads are moved away from the turntable 14 through a distance that is greater than that defined for normal operation of the machine so as to leave a space of sufficient size beneath the print station to allow the sheet 166 to pivot as shown in FIG. 6.

It should be observed that there is a slot or opening 180 formed in the protective sheet 166 in order to enable the article for printing to be inserted in part through said slot in order to receive printing via the print screen 134 shown in FIGS. 3*a* and 3*b*.

The structure and the operation of the article-carriers 16 as carried by the turntable 14 shown in FIG. 1 are described below with reference to FIGS. 7 to 10.

FIG. 7 shows one of these article-carriers 16 comprising an inlet shaft 200 driven by drive means that are described below.

The article-carrier 16 has a base 202 for securing to the by turntable 14 of FIG. 1, and on which there is mounted a moving portion 204 which, as explained below, can move away from the travel plane of the article-carriers and can move into a plurality of positions that are spaced apart along a vertical axis (z axis) which is perpendicular to the plane of the turntable 14.

The article-carrier 16 has an angle-changing gearbox 206 which receives as its inlet the inlet shaft 200 passing through the base 202 and transforms the turning movements of this vertical shaft to turn a horizontal shaft 208 that passes through the gearbox 206 (FIGS. 8 and 9).

The moving portion 204 of the article-carrier 16 is constituted by two side plates 210, 212 on either side of the gearbox 206 and which are mounted to pivot about the shaft 208 by ball bearings 216.

The end 224 of the rotary outlet shaft 218 opposite from the end carrying the gearwheel 222 is adapted to receive a mandrel 18 as shown in FIG. 1 and is turned by the shaft 208 via a gearwheel 220 secured thereto and meshing with the gearwheel 222 secured to the shaft 218.

Thus, the turning movement transmitted to the inlet shaft 200, which is said to be driven shaft, is subsequently transmitted by the above-described mechanism to the axis 208, and via the gearwheels 220 and 222, this movement is transmitted to the outlet shaft 218, thereby turning the article for printing that is mounted on the mandrel 18.

The article-carrier 16 also includes, in the bottom portion of the body of the moving portion 204, a guide element or wheel 226 of axis parallel to the axes of the shafts 208 and 218, for co-operating with a cam path that is shown in FIG. 1.

FIG. 10 shows a stationary table 230 secured to the frame 12 of the printer machine of the invention and including a cam path 232 within which the respective wheels 226 of the various article-carriers 16 shown in FIG. 1.

More particularly, this cam path, which is of generally circular shape, is formed by two parallel tracks constituted by a plurality of plates and wall elements that are curved or straight depending on location, disposed one after another around each track, the plates and wall elements of the two tracks being arranged parallel to one another and leaving between them a gap for passing the guide elements 226.

These two tracks comprise a portion 233 which corresponds to about half of the circular cam path and in which the mutually parallel plates are plane, thus keeping the guide elements 226 in plane path portions at a common vertical position along an axis perpendicular to the plane of the turntable 14.

This intermediate or neutral position is represented by the letter N (neutral) in FIG. 10.

The guide path 232 also comprises path portions or cams 234, 236, 238 in which the corresponding parallel wall elements and plates are curved upwards so as to form rising path portions (inclined ramps) for the guide element 226, thus bringing it into a high position referenced H.

The path 232 also has path portions or cams 240, 242, and 244 in which the corresponding parallel wall elements and plates are curved downwards so as to constitute descending path portions (inclined ramps) for the guide element 226, thus bringing it into a low position referenced B.

These rising and descending path portions are separated from one another by respective straight path portions 246, 248, 250, 252, and 254 which maintain the guide element 226 in the neutral or intermediate position N.

It should be observed that the upwardly-curved path portions and the downwardly-curved path portions which correspond to locally fitted cam profiles are respectively three in number, which number corresponds to the three print stations and to the three dryer stations.

The use of such curved path portions (cam profiles) and plane portions is described below with reference to FIG. 11*a* to 11*c*.

The table 230 comprises a base 260 on which the guide path 232 is fixed by vertical uprights 262 and by vertical wall elements 264.

The base 260 also includes six openings 266, 268, 270, 272, 274, and 276 which are designed to receive means for turning the various inlet shafts 200 of the article-carriers 16.

Each of these openings is designed to receive means for turning the shaft 200 of the corresponding article-carrier when it is positioned in one of the three print stations or in one of the three dryer stations, or in a predetermined zone very close to any one of them.

FIG. 11*a* to 11*c* are three diagrammatic views showing the principle of an article-carrier 16 carrying on its outlet shaft 218 an article 300, e.g. of cylindrical shape, in the various vertical positions, which positions have been exaggerated deliberately.

FIG. 11*a* shows the article-carrier 16 mounted on the turntable 14 with its guide element 226 placed in a straight portion of the guide path 232 of FIG. 10, holding said guide element in an intermediate or neutral vertical position N.

The path 232 is deliberately shown in dashed lines in these figures so that the other elements can be seen more clearly, with this being particularly useful in FIG. 11*c*.

When the turntable 14 turns in the direction shown by arrow 302 in FIG. 11*a*, the guide element 226 travels along the cam path 232.

When the guide element 226 reaches the rising portion of the path 234 (FIG. 11*b*), it follows the cam profile imposed by this path portion (inclined ramp) causing its vertical position to change, and thereby turning the moving portion 204 of the article-carrier 16 about the axis of the shaft 208, as shown by the arrow referenced 304, while continuing to be driven by the movement of the remaining portion of the article-carrier along the plane trajectory in the direction shown by arrow 302.

During this movement, the outlet shaft 218 carrying the article moves transversely to its axis, going away from the plane of the turntable 14.

This change in position of the guide element 226 brings the article into the high position in the slot 180 formed through the protective sheet 166 so as to come into contact with the print screen 134 of the corresponding print head (not shown in this figure).

When the article passes through the slot 180 formed in the protective sheet 166, it blocks off the opening almost completely, and by means of this configuration, the ultraviolet radiation from the dryer ovens has practically no further influence on printing operations.

In addition, by locating the print heads and the dryer ovens away from the turntable, more space is made available to increase the print length of the print screens, which print length were previously limited by the presence of the thermal protection elements.

When the article-carrier is in the position shown in FIG. 11*b*, i.e. the high position, the article 300 can receive printing, which requires the article to be turned, as described below.

Nevertheless, it is particularly advantageous to observe that the article 300 begins to be turned before the guide element 226 reaches the high position H, and continues to turn after it has begun to move down the slope, with this being for reasons that are given below.

As the guide element continues to move along the cam path 232 after the printing operation has been performed, it passes along a straight portion of path 246 where it is in the intermediate or neutral position N, after which it reaches a descending portion of path 240 (FIG. 11*c*).

The downward change in the vertical position of the guide element 226 (to low position B) causes the moving portion 204 of the article-carrier 16 to pivot about the axis of the shaft 208 in the direction shown by arrow 308, thus bringing the article 300 into the low position.

In this movement, the outlet shaft 218 carrying the article moves parallel to its axis away from the plane of the turntable 14.

As shown in FIG. 11*c*, the article 300 becomes partially engaged in a slot 310 formed in a protective casing 312 of one of the dryer ovens 38, 40, 42 of FIG. 1, with only a top wall 314 being shown in FIG. 11*c*.

The ability of the article-carrying portions of the article-carriers 16 to move vertically thus makes it possible not only to reach the print heads arranged above the turntable 14, but also to reach the dryer ovens arranged below the turntable.

When the article passes through the slot 310 formed in the protective screen 312 it shuts off the opening almost completely, and by this arrangement the amount of ultraviolet radiation emitted from the drying ovens is very greatly reduced, which radiation might otherwise influence printing operations.

The drying operation is also better controlled since heating power is adjusted to be as close as possible to requirements, there being no need for the ovens to be overdimensioned in order to compensate for losses as in the past.

In this arrangement of the printer machine of the invention, the dryer ovens are further away than in the past from the print heads, thus making it possible firstly to leave more room for the print length of the print screens, and secondly to reduce the influence of the ultraviolet radiation emitted by the ovens on the print heads.

It should be observed that the influence on the print heads, and more particularly the consequences of interfering radiation tending to dry or to polymerize the ink on the screen, would still be reduced even if only the print heads or only the ovens were offset from the turntable carrying the article-carriers.

The ability of the article-carriers to move in a direction perpendicular to the plane of rotation of the turntable 14 presents other advantages.

It should be observed that since the guide element or roll 226 on each article-carrier is inseparable from the guide path 232, the position of this guide element relative to the print heads or to the dryer ovens is independent of the turntable and of any defects it may have (warping, . . . ).

The position of the article that is to receive printing, when it is mounted on the article-carrier, is thus relatively unaffected by the influence of any defect in the planeness of the turntable 14.

In addition, it has been found that in prior art printer machines, while performing printing operations, non-negligible forces are exerted on the article that is to receive printing and thus on the article-carrier and the turntable.

This leads to deformation of the turntable which can be harmful to proper operation of the printer machine.

In addition, in order to avoid possible deformation of the turntable, manufacturers of printer machines have sometimes been led to overdimension the turntable in order to make it suitable for taking up such forces.

With the printer machine of the invention, the forces exerted during a printing operation on the article that is to receive printing are taken up by the guide element or roll 226 of the article-carrier, and are subsequently supported by the guide path 232 and thus by the base of the machine.

These forces are thus no longer conveyed to the turntable which therefore no longer needs to be overdimensioned.

It should also be observed that by varying the vertical position of the article-carrier, or at least of a portion thereof, and thus by varying the position of the article that is to receive printing, it is possible to adapt the printer machine to articles of different shapes and sizes.

It should be observed that the axial displacement of the article-carrier shaft that carries the articles without actuator is thus advantageously build up.

Furthermore, other means enabling the vertical position of the article-carriers, and more particularly the portions of the article-carriers that carry articles that are to receive printing, can be used instead of and replacing the guide element 226 and the cam path 232.

Instead of and replacing the cams 234, 240, 236, 238, 244, and 242, it is thus be possible, for example, to devise equipment having a cam path that is neutral all around its circular travel, but that is locally interrupted at the locations where the above-described cams are disposed in FIG. 10. The cams can then be replaced by vertically movable assemblies, each having a groove co-operating with the neutral cam path. Such assemblies can occupy a low position or a high position, moving by means of a worm's crew, for example, under the control of a brushless type motor synchronously with the movement of the article-carriers.

This variant is shown in highly diagrammatic manner in FIGS. 12*a*, 12*b*, and 12*c*, in which there can be seen the equipment 301 including the neutral cam path 303 in which the roll 226 travels.

The vertically movable assembly comprises an actuator, and more particularly a numerically-controlled motor 305 which controls rotation of a ball screw 307 mounted at the outlet of the motor, the screw being engaged in a threaded portion in the bottom of a substantially prismatic block 309 that forms a carriage, so that turning the screw in one direction or the other causes the carriage to move up or down (displacement of the carriage in translation).

A slot 311 is formed in the top portion of the carriage 309 to receive the roll 226 traveling along the path 303 (FIG. 12*a*) in the direction indicated by arrow 313, when the slot 311 is arranged at the same height as the path 303, as shown in FIG. 12*b*.

Once the wheel is held captive in the slot 311, the motor causes the assembly to rise by turning the ball screw 307, as shown by vertical arrow 315, thus enabling the article-carrier and the corresponding article to be brought into a high indexed position analogous to that shown in FIG. 11*b*, and opposite to the print stations.

The movement imparted by the motor to cause the carriage 309 to rise can start from the position shown in FIG. 12*b*, once the wheel penetrates into the slot 311.

The same applies for moving the article-carrier and the corresponding article into a low indexed position analogous to that shown in FIG. 11*c* opposite to dryer stations, by causing the carriage 309 to move downwards.

This variant is advantageous insofar as it enables practically vertical relative trajectories to be followed between the article and the protection elements 166 (print head) or 312 (oven), which is not possible when using a cam profile of the kind described above.

It is thus possible for the positioning of the article relative to the slot 180 (print head) or 310 (oven) to be adjusted even more accurately, thereby enabling the print screen to better protected from ultraviolet radiation than before.

As a result, the more accurate positioning of the article relative to the above-mentioned slot enables the size of the slot to be reduced, thereby additionally reducing the influence of radiation on the print screens.

It would also be possible, in addition to the above-described guide system using a roll and a cam path, to devise additional means on board each article-carrier in order to obtain additional movement adapted more accurately to the shape and/or size of the article that is to receive printing, whether the article-carrier is in its high position and/or in its low position.

As shown in FIG. 13, the various article-carriers 16 provided with their mandrels 18 which are fixed to the turntable 14 include respective clutch mechanisms 320 arranged beneath the turntable.

This mechanism is in the form of a cylindrical cup 321 having a horizontal bottom 321*a* from which there extends a vertical skirt 321*b*. The bottom portion of the cup is open as can be seen in FIG. 13 and the inlet shaft 200 of each corresponding article-carrier is mounted securely in a central hub 322 secured to the bottom 321*a* of the cup, as shown in FIGS. 14 and 15 (in these figures, the inlet shaft 200 of the article-carrier is not shown).

It will thus be understood that turning the cup 321 causes the inlet shaft 200 of each article-carrier to turn, and consequently also causes the outlet shaft 218 of the article-carrier and thus the article to turn, as described above.

The arrangement of the clutch mechanism 320 beneath the article-carrier is shown in a front view in FIG. 17.

As shown in FIGS. 14 to 16, the clutch mechanism 320 comprises more particularly an assembly of two rollers and two rolls mounted in pairs on two parallel shafts, one set of wheels 324, 326 and one set of rollers 328, 330, each of the sets of rotary members being mounted on a shaft secured to two parallel arms 332, 334 which are secured to a jaw 336 diametrally opposite from the two above-mentioned sets of members. In the clutched position of the mechanism, the jaw 336 comes into contact with the inside wall of the skirt 321*b* of the cup 321 under drive from springs 338.

A guide element 340 or roller mounted to rotate about a vertical axis projects from the mechanism constituted by the rollers, wheels, arms, and jaws, this element making it possible in the clutched position of the mechanism as shown in FIG. 14 which is a view in section on plane AA of the mechanism shown in FIG. 16, to transmit turning movement to the cup 321 which is in contact with the jaw 336, and thus to the inlet shaft 200 of the article-carrier in question.

As explained below, this turning movement is imparted thereto by a drive shaft of a driver.

It should be observed that in the clutched position shown in FIG. 14, the roller or guide element 340 is in a low position and the wheels 324 and 326 are in contact with a first portion 342 of a steeply-sloping ramp.

As explained below, when external means are actuated to bear against the rollers 328 and 330, that causes the arms 332 and 334 to rise and thus causes the wheels 324 and 326 to rise, which wheels move up the sloping ramps 342 and reach a ramp 344 that slopes less steeply. This has the effect of exerting traction force on the jaw 336 via the arms 332 and 334, compressing the springs 338, and thus creating clearance between the inside wall of the skirt 321*b* and the jaw.

The mechanism is then in the declutched position shown in FIG. 15, which is a section view on plane BB of the FIG. 16 mechanism, in which position, turning of the guide element 340 can no longer be transmitted to the cup 321 and thus to the inlet shaft 200 of the article-carrier.

Consequently, when the mechanism 320 is in the declutched position, external means, which are described below, intervene to turn the cup 321 and thus the inlet shaft 200 of the article-carrier when the article-carrier is in a particular indexed position of the turntable (flame cleaning, dedusting, pre-registry, and registry).

It should be observed that two rolling means 350 and 352 are provided for rotary mounting about the hub 322, as shown in FIGS. 14 and 15.

It can thus be seen that the clutch mechanism passes from a clutched position to a declutched position and vice versa when the position of the guide element 340 along an axis perpendicular to the travel plane of the article-carriers varies, and when, as a function of this position, the article carried by the article-carrier is turned by said guide element via the clutch mechanism or by via different external means.

The guide element or roller 340 serves to guide the movement of the article-carrier on its circular travel following a guide path shown in FIG. 18.

It should be observed that in a variant, the clutch mechanism could alternatively present a groove co-operating with an external roller for turning the outlet shafts of the article-carriers.

The plate 360 shown in FIG. 18 is for fixing on the stationary table 230 shown in FIG. 10 and which is not shown again in this figure for reasons of clarity.

Wall elements of curved shape are positioned on the plate 360 in pairs one after another along a path of generally circular shape and they are spaced apart from one another within a given pair, so as to leave between them a stationary path portion.

The guide path 361 thus comprises a succession of stationary path portions 362*a*, 362*b*, 364*a*, 364*b*, 366*a*, 366*b*, 368*a*, 368*b*, 370*a*, 370*b*, 372*a*, 372*b*, 374*a*, 374*b*, 376*a*, 376*b*, 378*a*, 378*b*, 380*a*, 380*b*, 382*a*, 382*b*.

The stationary path portions are locally interrupted opposite to predetermined zones, shown in FIG. 18 at openings 384, 386, 388, 390, 392, and 394 coinciding respectively with openings 266, 267, 270, 272, 274, 276, and 278 in the stationary table of FIG. 10, each serving to receive a moving path portion. More particularly, each moving path portion is mounted to turn about an axis perpendicular to the travel plane of the article-carriers, i.e. to the plane of the table 360.

Each moving path portion arranged between two stationary path portions is mounted at the end of drive means that are described below and that turns the inlet shaft 200 of each article-carrier, and thus turns its outlet shaft 218 carrying the article that is to receive printing.

Such drive means are shown in FIGS. 19 and 20.

FIG. 19 shows an actuator 400 forming part of the above-mentioned drive means and comprising a brushless motor 402 having, at one of its ends, an outlet shaft 404 constituting a drive shaft having a toothed pulley wheel 406 mounted thereon.

A cylindrical housing 408, referred to as a drive carrier, has openings to give access to the elements it surrounds, and is mounted concentrically around the axis 404, having a free one of its ends carrying a part 410 made up of two semi-circular portions separated by a rectilinear slot 412, said part 410 being constrained to turn with the drive shaft 404.

The part 410 constitutes a moving path portion for insertion into one of the openings 384, 386, 388, 390, 392, and 394 of the table 360 of FIG. 18.

The turning part 410 is, for example, shown in FIGS. 21*a* to 21*g* disposed between fixed path portions constituted by paired wall elements 376*a* & 376*b* and 378*a* & 378*b* on either side of the opening 390.

All of the moving path portions inserted in the above-mentioned openings in the table 360 of FIG. 18 are identical to the part 410 provided with the slot 412 shown in FIG. 19.

Nevertheless, the drive means on which the moving path portions 410 are secured differ depending on the particular opening in the table.

More particularly, FIG. 20 is a perspective view from the underside of the table 360 of FIG. 18 in which the various drive means are arranged having respective drive axes for turning the inlet shafts 200 of the article-carriers in temporarily and local manner via, in succession, the moving path portion 410, the guide element 340, and the clutch mechanism 320.

It should be observed that when the guide element 340 moves in the fixed path portions, i.e. between two indexed positions of the turntable away from the predetermined zones corresponding to the zones situated in the vicinity of the indexed positions, the index shafts 200 remain in the same angular position since they do not turn.

The stationary actuator of FIG. 19 is held in position by being fixed to the base 12 of the machine so that the moving path portion which is associated therewith is engaged in the opening 388 of the table 360.

The actuator 400 is suitable for transmitting the turning movement of its drive shaft 404 to two drivers 420, 422 via a cog belt 424 which turns the drive shafts corresponding to these two drivers 420 and 422.

FIG. 17, which is a view from the center of the turntable 14, shows the driver 422 which comprises a driver carrier 426 of perforated cylindrical shape having mounted therein a drive shaft 428 perpendicular to the horizontal travel plane of the article-carriers and carrying top and bottom bearings (not visible in FIG. 17).

A toothed pulley wheel 430 is mounted on the drive shaft 428 in order to receive the drive belt 424.

At the driver, in register with a print head, an incremental coder 431 is mounted on the shaft of the driver to subdivide turning of the article into 20,000 points used for controlling the variable controller of the motor 402 of the actuator 400.

This information is transmitted directly to the motor for moving the print screen which causes movement in translation over a perimeter of the article that is subdivided by 20,000 for one increment received from the coder.

This makes it possible to avoid being affected by slack in mechanical transmission upstream from the axis of the driver, e.g. due to eccentricity of the belt-pulley wheel.

This also makes it possible to increase or decrease the corresponding distance along the article merely by parameterizing the ratio between displacement and sensed increment.

It should be observed that an incremental coder 431 is provided for each of the assemblies comprising drive means at a print station or at a dryer station (FIG. 20).

The driver 420 is identical in structure to the driver 422 of FIG. 17.

It should be observed that the actuator 400 and the two drivers 420 and 422 serve to turn the articles while the corresponding article-carriers are situated in print stations.

This configuration makes it possible, advantageously, to use only one actuator for controlling the turning of the articles in the print stations.

An arrangement identical to that described above is provided for turning articles in the dryer stations, using an actuator 440 which transmits the turning movement of its drive shaft to two drivers 442 and 444 by means of a cog belt 446, in a manner identical to that described above for the actuator 400 and the drivers 420 and 422.

The drivers 442 and 444 are practically identical to above-described drivers 420 and 422 in terms of structure and operation.

In FIG. 17, it can be seen that the driver 422 carries a moving path portion 410 at the end of the drive shaft 428 that is identical to that shown in FIG. 19 and that is centered on the drive shaft of the drive means under consideration.

It should be observed that the dimensions of the moving path portion in a horizontal plane, i.e. its diameter, are greater than the dimensions of the guide element or roller 340 so that they can co-operate with each other, as described below.

As described above, when the clutch mechanism 320 of an article-carrier is in the clutched position, turning of the drive shaft of the drive means situated beneath it causes the moving path portion 410 to pivot, which moving path portion has the guide element 340 received therein, thereby causing the cup 321 to turn and also causing the inlet shaft 200 of the article-carrier to turn.

Consequently, the outlet shaft 218 of the article-carrier which receives the mandrel 18 carrying the article is likewise caused to turn about its own axis.

In conventional printer machines, the article that is to receive printing or that is to be dried is turned when the turntable supporting the article-carriers is stopped in an indexed position corresponding to the article-carrier being positioned at a print station or a dryer station.

Nevertheless, the printer machine of the invention enables the inlet shaft 200 of an article-carrier to be turned even while the turntable 14 supporting the article-carriers is moving.

Such simultaneous movement is made possible when the article-carrier lies in a predetermined zone of its circular path, and in particular in the vicinity of the print stations and dryer stations in which the guide roll 226 is respectively in its high position H or its low position B.

This double movement is possible over a rising or descending path portion on either side of the position H (FIG. 11*b*) and over a descending or rising path portion on either side of the position B (FIG. 11*c*).

This angular position amplitude of the article-carrier is determined by the extreme positions of the guide element 340 inside the slot 412 (FIG. 17).

It is possible for the inlet shaft 200 of the article-carrier and thus for the article itself to be turned so long as the guide element 340 is to be found in the moving path portion 410, regardless of whether or not the inlet shaft 200 is in alignment with the drive shaft of the drive means in question.

FIGS. 21*a* to 21*g* show a moving path portion 410 (opposite to a dryer station) arranged between stationary path portions constituted by corresponding pairs of curved wall elements 376 & 376*b* and 378*a* & 378*b*, inserted in the opening 390 of the table 360 shown in FIG. 18.

Figure 21A:
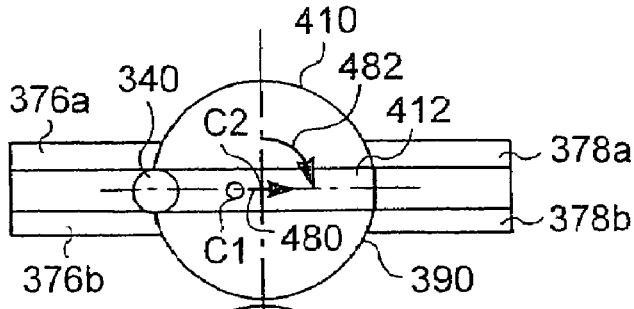

In FIG. 21*a*, there is shown the approach movement of the article-carrier, with the axis of the corresponding drive shaft passing via the point C1, while the point C2 is the point through the axis of the shaft of the corresponding drive means passes.

In this first figure, the article-carrier is guided along a circular path by the guide element 340 which leaves a stationary path portion (376*a* & 376*b*) to enter into the moving path portion 410.

The corresponding displacement of the article-carrier is represented by the arrow referenced 480 and the point C1 through which the axis of the inlet shaft 200 of the article-carrier passes moves towards the point C2 through which the axis of the drive shaft of the actuator passes.

Starting from this position of the article-carrier for which the guide element 340 is guided in the slot 412, the drive shaft of the corresponding drive means, in this case the actuator 440, can be turned thereby, as represented by arrow 482.

This turning movement causes corresponding turning of the article to be dried and is combined with movement displacing the article-carrier along its circular path, as represented by arrow 480.

Since the actuator 440 is provided to control the turning movements of articles in the dryer stations, the corresponding movement of the article-carrier in order to reach a dryer station is downward pivoting, as shown in FIG. 11*c*, with the guide roll 226 heading towards the low position B in the guide path.

Figure 21B:
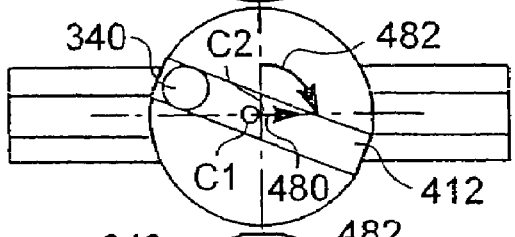
Figure 21C:
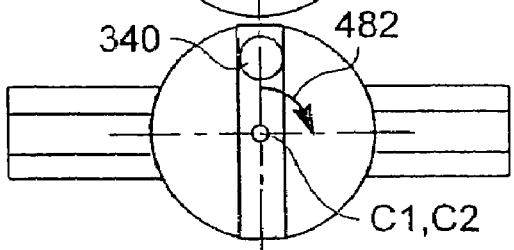

In the following FIG. 21*b*, the combined movement continues, with the point C1 moving towards the point C2 until these two points coincide as shown in FIG. 21*c*.

In the position shown in FIG. 21*b*, the guide roll 226 is in its low position B, as shown in FIG. 11*c*, and the article-carrier is thus in an extreme position.

Figure 21D:
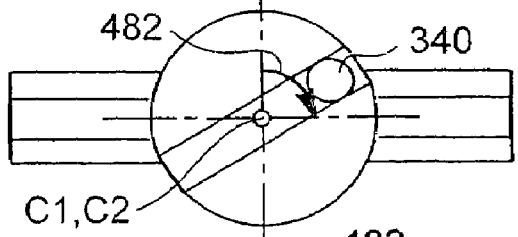
Figure 21E:
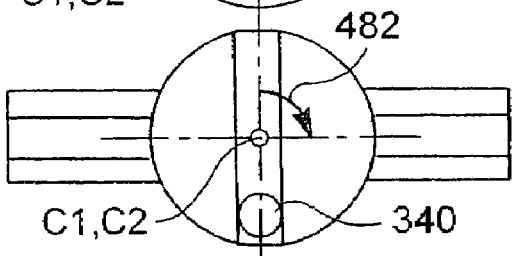

The turning movement of the article continues in FIGS. 21*d* and 21*e* while the turntable and the article-carriers are stopped in an indexed position, with the movements of the drive shaft and the inlet shaft 200 then taking place at the same speed.

After some number of revolutions of the article, in this case an integer number, the drying operation is terminated and the guide element 340 is then to be found, for example, in the position shown in FIG. 21*e*.

It should be observed that the moving path portion 410 possesses an angular orientation relative to the stationary path portions which is such that the two successive path portions are not in alignment, thereby preventing the guide element from going from one to the other.

Figure 21F:
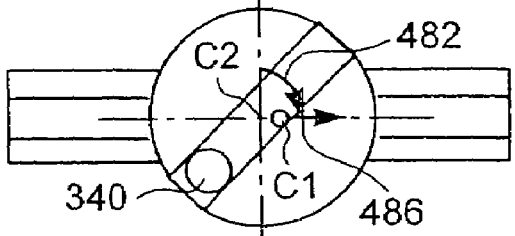
Figure 21G:
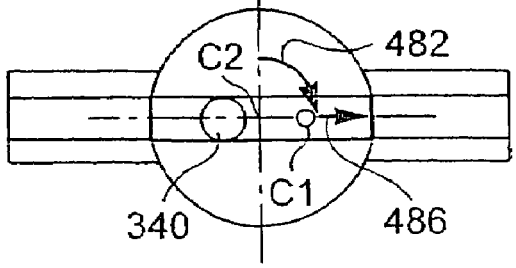

Starting from this position, it is therefore necessary to bring the moving and stationary path portions into alignment, with this taking place while continuing to turn the article in the direction shown by the arrow referenced 482 in FIG. 21*f* and 21*g*.

Simultaneously, the turntable restarts its own turning movement, taking with it the article-carriers which move as shown by the arrow referenced 486 in FIG. 21*f*, the point C1 of the article-carrier then being moved away from the point C2, to the right in the figure.

It should be observed that in the prior art it is necessary to keep the turntable stationary while the driver and the guide are being brought back into alignment.

As shown in FIG. 21*g*, the turning movement of the moving path portion 410, and thus of the article, comes to an end when the moving and stationary path portions are back in alignment, whereas the movement of the turntable and of the article-carriers continues, as is shown by the points C1 and C2 becoming ever further apart.

The guide element 340 will then shortly leave the moving path portion and enter the stationary path portion as defined by the curved wall elements 378*a* and 378*b*.

It can thus be understood that during turning of the turntable, and thus of the article-carriers, the articles can be made to turn in background time.

Thus, in anticipated manner, the article 300 shown in FIG. 11*c* is caused to turn before it penetrates into the slot 310 of the drying oven (FIG. 21*b*) and also at the end of the drying operation (FIG. 21*f*), with the article-carrier starting to move again, thereby distributing ultraviolet radiation in uniform manner around the periphery of the article.

The ability to cause the article to turn while it is approaching the slot 310 formed in the dryer oven makes it possible to avoid overexposure of the article to radiation, which is harmful to print quality.

Similarly, the combined movement in rotation and translation of the article also makes it possible to avoid underexposing certain zones thereof.

This makes it possible to avoid any need to overdimension the ovens in order to avoid having zones on the article which are underexposed to radiation.

Furthermore, the use of background time for turning the article while moving the article-carrier is also advantageous in the print stations, whether before or after printing.

In the print stations, there is sometimes a need to implement print extra print length that make it necessary, when printing all the way round an article, to begin the print operation before the beginning of the complete revolution and to continue the operation after the complete revolution has come to an end, with this being for reasons associated with the silk-screen printing technique.

FIGS. 22*a* to 22*h* show a moving path portion 410 (opposite to a print station) arranged between two stationary path portions constituted by corresponding curved wall elements 374*a* & 374*b* and 376*a* & 376*b*, inserted in the opening 388 in the table 360 of FIG. 18.

For simplification purposes, the notation used in FIG. 21*a* to 21*g* is repeated in these figures for elements that are common thereto.

Opposite to the print station in question, the actuator 440 serves to control turning of the articles and to control the corresponding movement of the article-carrier to move into a print station is an upward pivoting movement, as shown in FIG. 11*b*, with the guide roll 226 traveling towards the high position H in the guide path.

Figure 22A:
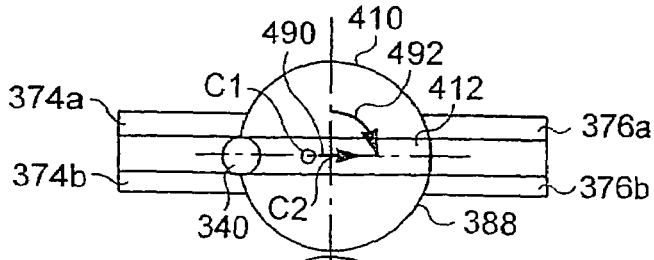
Figure 22B:
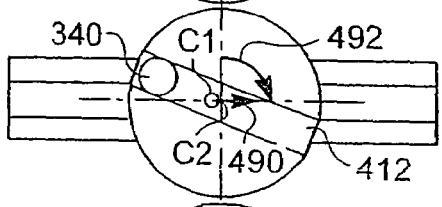
Figure 22C:
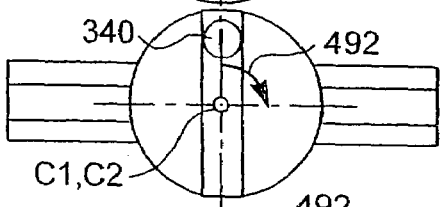

It can thus be seen in FIGS. 22*a* to 22*c* that the movement of the article-carrier as represented by the arrow referenced 490 takes place simultaneously with turning of the moving path portion 410 (arrow referenced 492) and thus with rotation of the roller 340 and with turning of the article that is to receive printing.

The point C1 moves towards the point C2 until it coincides therewith in FIG. 22*c* which corresponds to the turntable being in an indexed position.

Figure 22D:
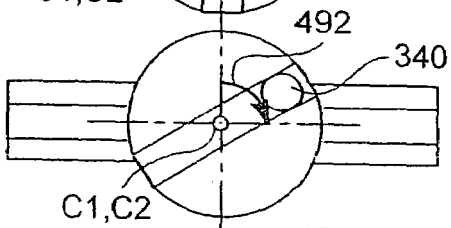
Figure 22E:
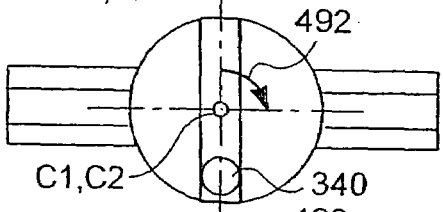
Figure 22F:
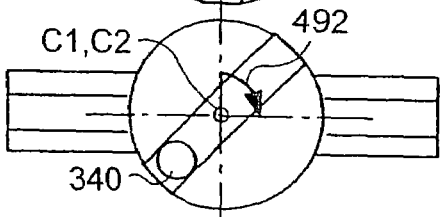
Figure 22G:
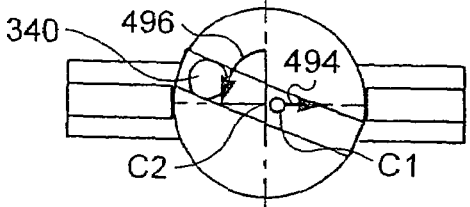

Turning movement of the article continues in FIGS. 22*d*, 22*e*, and 22*f*, and up to FIG. 22*g* where the roller 340, and thus the article, has performed more than one revolution, thus corresponding to a extra print length.

Starting from the position of FIG. 22*g*, the moving path portion 410 turns in the opposite direction, as shown by the arrow referenced 496, so as to bring this path portion into alignment with the stationary path portions, while the turntable starts to turn again, taking with it the article-carrier in question, as shown by the arrow referenced 494.

Figure 22H:
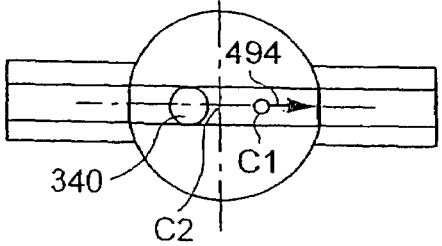

This causes the point C1 to move away from the point C2, and this movement continues in FIG. 22*h* where the moving path portion has the same angular orientation as the stationary path portions, thus allowing the roller 340 to leave the moving path portion.

It should be observed that the combined simultaneous movement is also advantageous when it is necessary to implement positioning corrections prior to beginning printing.

The need to correct the relative position of the print screen relative to the angular position of the article prior to beginning printing can be better understood with reference to FIG. 23 and also to FIG. 1.

Initially, an article is engaged on the mandrel 18 of an article-carrier 16 in a conventional loading station (not shown) which is disposed in register with the article-carrier referenced by the letter A in FIG. 1. The article-carriers referenced by the letters B and C are in positions which correspond respectively to the flame-cleaning and the dedusting stations, operations that are preliminaries to printing and that will subsequently be performed on the article carried by the article-carrier presently situated at the loading station, once the turntable 14 has moved successively into the corresponding indexing positions.

The article-carriers identified by letters D and E are in angular positions corresponding respectively to the pre-registry station and to the registry station.

The article-carriers identified by letters F and G, and those identified by the letters H and I and J and K are in positions that correspond respectively to a print station and to a dryer station.

The article-carrier identified by the letter L is in a position corresponding to an article-unloading station.

There can thus be seen at the flame-cleaning and dedusting stations, and also at the pre-registry and registry stations, two arrangements that are practically identical and referenced 500 and 502 respectively, with only one such arrangement 500 being shown in FIG. 23.

This arrangement comprises two motor and gearbox units 504 and 506 each having its drive axis perpendicular to the travel plane of the article-carriers (the plane of the turntable 14).

These two motor and gearbox units are secured to a support plate 508 and their respective drive shafts pass therethrough and carry two respective drive wheels 510 and 512, the plate 508 being secured to a vertical upright 262 of the stationary table 230.

The drive wheels 512 and 510 serve to turn the cups 321 of the clutch mechanisms 320 of two article-carriers identified by letters D and E in FIGS. 1 and 23.

It should be observed that in this figure only a few of the article-carriers are shown, for simplification purposes.

The drive wheels 512 and 510 co-operate by friction with the outside portions of the skirt 321*b* of the cup 321 when the clutch mechanism is in the declutched position, as shown in FIG. 15.

This declutched position is obtained by varying the vertical positions of the rollers 328, 330 of FIGS. 14 to 16, and more particularly by causing these rollers to rise inside the cup 321.

This is done by additional means shown in FIG. 18 as the paired wall elements 362*a*, 362*b* which are of thickness that increases progressively going from one end to the other.

When the guide roller 340 moves inside the sloping stationary path portion defined by these wall elements, the rollers 328 and 330 of the mechanism 320 come into contact with the top portions of these wall elements and thus rise progressively, thereby leading, as described with reference to FIG. 15, to the wheels 324 and 326 moving from the inclined ramp 342 to the inclined ramp 344.

Once the jaw 336 is separated from the inside wall of the cup 321, the inlet shaft 200 of the article-carrier can then be turned by only one of the drive wheels 512 or 510 of FIG. 23, depending on the station in question.

It should be observed that the variation in the thickness of the wall elements constituting the above-mentioned stationary path portion, is arranged after the loading station and before the flame-cleaning station, corresponding in FIG. 1 to the angular positions of the article-carriers identified by letters A and B, respectively.

It should be observed that the clutch mechanism 320 of an article-carrier remains in the declutched position so long as the article-carrier travels along stationary path portions defined by respective wall elements 364*a* & 364*b* and 366*a* & 366*b*.

The stationary path portion defined by the wall elements 364 and 364*b* corresponds to the flame-cleaning and dedusting stations, while the path portion defined by the wall elements 336*a* and 366*b* correspond to the pre-registry and registry stations.

When an article-carrier is at the registry station (article-carrier identified by the letter E in FIG. 1), the two rollers 328 and 330 of its clutch mechanism 320 overlie an actuator member 520 which has a U-shaped part 522 (FIG. 24) disposed at the end of an actuator 524, the two rollers 328 and 330 being placed respectively above the two limbs of the U-shape.

In this position, in the registry station, rotation of the article carried by the corresponding article-carrier is driven by the drive wheel 510 shown in FIG. 23.

Once the registry operation has been performed, and before the turntable begins to turn again, the actuator is lowered, thereby lowering the U-shaped part and thus enabling the rollers 328 and 330 to move down, thereby moving the clutch mechanism 320 as a whole into a clutched position as shown in FIG. 14.

When the clutch mechanism 320 of an article-carrier is in the declutched position and the corresponding article-carrier is in the pre-registry station of FIG. 23, the pre-registry motor 506 is caused to turn until reaching a cell or an identifier or a mark on the article that is to receive printing, so as to bring the article by appropriate turning into an angular position that is close to the position in which it needs to be for the printing operation.

Thereafter, the article-carrier is moved by the indexed turning of the turntable to the registry station where the registry motor 504 serves to position the article, to receive printing in an accurate angular position so that the subsequent printing operation can start at the desired location on the outside surface of said article.

Nevertheless, it can happen that after an article has been put into its registered position for printing, the relative angular position of the article relative to the print screen is still not the desired position.

This can be detected, for example by a camera system which, on viewing the image of the angular position of the article at the end of the registry stage compares said image with a reference image representing the angular position that is desired for said article prior to the printing operation.

On the basis of this comparison performed by an electronic processor unit, the unit can deduce an angular correction to be applied to the article before beginning printing.

Under such circumstances, using the combined turning movement of the article while it is being moved in translation, while the turntable is turning, it is possible to perform said angular correction before the printing operation starts.

Thus, for equal cycle shares, i.e. in terms of turntable stop time and time during which the turntable is in movement, the use of combined movement both in turning and in translation of the article that is to receive printing makes it possible to increase quite considerably the time that is available for the printing and drying operations proper.

It can thus be said that for given printing speed and printing and drying characteristics, the throughput of the printer machine of the invention is increased relative to the throughputs of prior art machines.

For example, the printer machine of the invention enables 6000 articles to be processed per hour using printing speeds that are equivalent to those of a machine of known type, such as, for example, the machine described in document FR 2 782 292, which operates at a rate of 4000 articles per hour, only.

The machine of the invention can thus dry 6000 articles an hour, as explained in document FR 2 789 933, under the same conditions of ink deposition and speed of polymerization as those used in the machine described in document FR 2 782 292 whose throughput is only 4000 articles per hour.

It should be observed that the printer machine of the invention also includes a compressed air feed system which, by means of appropriate mechanical members (manifolds with control members, suction cups, . . . ) and suitable trigger devices, enables the holding or release of articles on the article-carriers and the holding or release of said articles to be controlled by means of air suction.

The invention claimed is:

1. A printer machine for printing on articles, the machine comprising a plurality of article-carriers (16) each having a portion fitted with at least one shaft (218) for carrying at least one article, the article-carriers being suitable for moving in indexed manner along at least one plane path, the printer machine having a plurality of print stations where printing is applied to the articles and which are interposed with stations for drying articles that have received printing, the machine being characterized in that the shaft for carrying said at least one article in each article-carrier is also suitable for moving parallel to its axis in the vicinity of print stations which are offset from the travel plane of the article-carriers, and for moving away from said plane so as to bring the article into position for printing inside a slot (180), said slot being formed in a protective screen (166) which protects the corresponding print station from the radiation coming from the dryer stations.

2. A printer machine according to claim 1, characterized in that the shaft for carrying said at least one article of each article-carrier is also suitable for moving parallel to its axis, in the vicinity of the dryer stations which are offset from the travel plane of the article-carriers, and for moving away from said plane, so as to bring the article into position for drying opposite to a slot (310), said slot being formed in a protective element (312) which forms a screen against the radiation coming from the corresponding dryer station.

3. A printer machine according to claim 1, characterized in that the print stations and the dryer stations are arranged respectively on opposite sides of the travel plane of the article-carriers.

4. A printer machine according to claim 1, characterized in that the portion of each article-carrier that includes the shaft (218) is also suitable for moving away from the travel plane of the article-carriers and is referred to as a first portion, the remaining portion of the article-carriers, referred to as a second portion, being suitable solely for traveling along the plane path.

5. A printer machine according to claim 4, characterized in that the first portion of each article-carrier is pivotally mounted relative to the second portion.

6. A printer machine according to claim 1, characterized in that the shaft (218) of each article-carrier is moved away from the travel plane of the article-carriers by co-operation with the portion of each article-carrier that includes said shaft and a locally-adapted cam profile.

7. A printer machine according to claim 6, characterized in that the portion of each article-carrier including the shaft (218) has a guide element which is suitable for moving along a guide path that comprises, outside those portions of the path that have the locally-adapted cam profile, portions that are substantially plane lying in a plane parallel to the travel plane of the article-carriers.

8. A printer machine according to claim 6, characterized in that in the vicinity of each print station and/or each dryer station, the cam profile comprises a sloping ramp.

9. A printer machine according to claim 1, characterized in that the shaft (218) on each article-carrier is moved away from the travel plane of the article-carriers by co-operation between the portion of each article-carrier including said shaft and a stationary actuator.

10. A printer machine according to claim 9, characterized in that the actuator is suitable for causing the shaft (218) to move perpendicularly to the travel plane of the article-carriers.

11. A printer machine according to claim 10, characterized in that the actuator is suitable for turning a ball screw on which a carriage is mounted to move in translation in a direction perpendicular to the travel plane of the article-carriers, said carriage being provided with a slot for co-operating with a guide element of the portion of each article-carrier that includes said shaft in order to cause said guide element to move during movement of the carriage in translation.

12. A printer machine according to claim 1, characterized in that it includes means for adjusting the distance of the print stations relative to the travel plane of the article-carriers as a function of the dimensions of the articles that are to receive printing.

13. A printer machine according to claim 12, characterized in that, for print stations including respective print screens protected from radiation by the protective screen (166), the means for adjusting the distance of the print stations relative to the travel plane of the article-carriers are adapted to lift said print stations away from said plane through a distance that allows maintenance operations to be performed, in particular on the print screen.

14. A printer machine according to claim 13, characterized in that the protective screen of each print station is retractable in order to allow maintenance operations to be performed on the print screen.

15. A printer machine according to claim 1, characterized in that it includes means for adjusting the distance of the dryer stations relative to the travel plane of the article-carriers as a function of the dimensions of the articles to be dried.

16. A printer machine according to claim 1, characterized in that the article-carriers are suitable for moving along a circular trajectory.

17. A printer machine according to claim 1, characterized in that it includes an indexed turntable on which the article-carriers are mounted.

* * * * *